US009751603B2

(12) United States Patent
Lee et al.

(10) Patent No.: US 9,751,603 B2
(45) Date of Patent: Sep. 5, 2017

(54) PROPULSION DEVICE FOR SHIP AND SHIP COMPRISING THE SAME

(71) Applicant: SAMSUNG HEAVY IND. CO., LTD., Seoul (KR)

(72) Inventors: Dong-Hyun Lee, Daejeon (KR); Jong-Soo Seo, Daejeon (KR); Tae-Goo Lee, Daejeon (KR); Kwang-Jun Paik, Daejeon (KR); Kwang-Kun Park, Daejeon (KR); Seung-Myun Hwangbo, Busan (KR); Ji Nam Kim, Tongyeong-si (KR); Hyuk Kwun, Geoje-si (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 368 days.

(21) Appl. No.: 14/399,948

(22) PCT Filed: May 8, 2013

(86) PCT No.: PCT/KR2013/003990

§ 371 (c)(1),
(2) Date: Nov. 7, 2014

(87) PCT Pub. No.: WO2013/168986

PCT Pub. Date: Nov. 14, 2013

(65) Prior Publication Data

US 2016/0194066 A1 Jul. 7, 2016

(30) Foreign Application Priority Data

May 10, 2012 (KR) ..... 10-2012-0049616
May 11, 2012 (KR) ..... 10-2012-0050169
May 11, 2012 (KR) ..... 10-2012-0050175

(51) Int. Cl.
*B63H 5/10* (2006.01)
*B63H 23/30* (2006.01)
(Continued)

(52) U.S. Cl.
CPC ..... *B63H 5/10* (2013.01); *B63H 23/30* (2013.01); *B63H 23/321* (2013.01); *B63H 23/34* (2013.01);
(Continued)

(58) Field of Classification Search
CPC .... B63H 5/10; B63H 23/34; B63H 2005/106; B63H 2023/342; B63H 23/30
See application file for complete search history.

(56) References Cited

U.S. PATENT DOCUMENTS 2,973,845 A * 3/1961 Sinclair ..... B63H 23/08 192/218
3,752,281 A * 8/1973 Arnold ..... F16D 25/123 137/625.24
(Continued)

FOREIGN PATENT DOCUMENTS

EP 0 132 220 1/1985
EP 2 236 408 10/2010
(Continued)

OTHER PUBLICATIONS

Westinghouse Marine Equipment, 1914, Journal of tho American Society for Naval Engineers, vol. 26 Iss 3, pp. 933-937.*
(Continued)

*Primary Examiner* — Dwayne J White
*Assistant Examiner* — John S Hunter
(74) *Attorney, Agent, or Firm* — Ladas & Parry, LLP

(57) ABSTRACT

Disclosed are a propulsion device for a ship and a ship having the same. The propulsion device may include a rotational shaft, a rear propeller fixed to the rotational shaft,
(Continued)

a front propeller rotatably supported by the drive shaft in front of the rear propeller, a counter rotation unit disposed in an installation space of a stern of a ship body and including a plurality of gears configured to reverse rotation of the rotational shaft and transmit the reversed rotation to the front propeller and a gear box configured to receive the plurality of gears, a coupling unit configured to separably connect the rotational shaft with the counter rotation unit and cut off power transmission from the rotational shaft to the counter rotation unit upon disconnection therebetween, and a rotation preventing unit configured to prevent rotation of the front propeller when the coupling unit is separated.

11 Claims, 19 Drawing Sheets

(51) Int. Cl.
*B63H 23/36* (2006.01)
*B63H 23/32* (2006.01)
*B63H 23/34* (2006.01)

(52) U.S. Cl.
CPC ..... *B63H 23/36* (2013.01); *B63H 2005/106* (2013.01); *B63H 2023/323* (2013.01); *B63H 2023/342* (2013.01); *B63H 2023/346* (2013.01)

(56) References Cited

U.S. PATENT DOCUMENTS

| | | | | |
|---|---|---|---|---|
| 4,642,059 | A * | 2/1987 | Nohara | B63H 5/10 416/129 |
| 5,030,149 | A | 7/1991 | Fujita | |
| 7,291,048 | B1 * | 11/2007 | Phillips | B63H 20/20 192/21 |

FOREIGN PATENT DOCUMENTS

| | | | |
|---|---|---|---|
| JP | 60-121191 | | 6/1985 |
| JP | 62-61894 | | 3/1987 |
| JP | 62-279189 | | 12/1987 |
| JP | 63-93698 | A | 4/1988 |
| JP | 63-66399 | | 5/1988 |
| JP | 1-237289 | | 9/1989 |
| JP | 02-212293 | A | 8/1990 |
| JP | 3-99245 | | 10/1991 |
| JP | 5-193563 | | 8/1993 |
| JP | 09-301276 | A | 11/1997 |
| JP | 2004-314897 | | 11/2004 |
| KR | 1995-0031777 | A | 12/1995 |
| WO | 95/03211 | | 2/1995 |

OTHER PUBLICATIONS

Office Action dated Nov. 4, 2015 for Japanese Patent Application No. 2015-511359 and its English machine translation provided by Applicant's foreign counsel.

International Preliminary Report on Patentability (Chapter II) for PCT/KR2013/003990 of Jul. 23, 2014 and its English translation from WIPO.

Written Opinion of the International Search Authority for PCT/KR2013/003990 mailed on Jul. 9, 2013 and its English machine translation by Google Translate.

Extended European Search Report dated Mar. 9, 2016 for European Patent Application No. 13788165.2.

International Search Report for PCT/KR2013/003990 mailed on Jul. 9, 2013 and its English Translation.

* cited by examiner

PROPULSION DEVICE FOR SHIP AND SHIP COMPRISING THE SAME

CROSS-REFERENCE TO RELATED APPLICATIONS

This application is the U.S. National Stage of International Patent Application No. PCT/KR2013/003990, filed on May 8, 2013, which claims priority to Korean Patent Application Nos. 10-2012-0049616 filed, on May 10, 2012, 10-2012-0050169, filed on May 11, 2012, and 10-2012-0050175, filed on May 11, 2012, the disclosures of which are hereby incorporated by reference in their entireties.

TECHNICAL FIELD

The present invention relates to a ship, and more particularly, to a propulsion device for a ship in which two propellers generate propulsive force via counter rotation thereof, and a ship having the same.

BACKGROUND ART

Generally, a single spiral propeller is used in a propulsion device for a ship. However, the propulsion device having a single propeller may not acquire propulsive force from rotational energy of water streams, and thus causes substantial energy loss.

A counter rotating propeller (CRP) type propulsion device may acquire propulsive force from the rotational energy lost. In the counter rotating propeller type propulsion device, two propellers installed on the same axis generate propulsive force via counter rotation thereof. A rear propeller acquires propulsive force from rotational energy of fluid passing through a front propeller. Accordingly, the counter rotating propeller type propulsion device may exhibit higher propulsion performance than the propulsion device having the single propeller.

However, the counter rotating propeller type propulsion device includes a counter rotation unit in which the two propellers are reversely rotated with respect to each other, a hollow shaft or the like, and thus it is relatively difficult to manufacture and install the counter rotating propeller type propulsion device, and also a high technical standard is required to stably operate the propulsion device while maintaining reliability thereof.

Further, in the counter rotating propeller type propulsion device, a separate unit for emergency operation which may operate a ship with a remaining propeller, when one of the propellers may not be driven by a breakdown in the counter rotation unit, is required.

DISCLOSURE

Technical Problem

The present invention is directed to providing a propulsion device for a ship, which is capable of performing stable counter rotation of two propellers while more simplifying a power transmission system thereof than in the conventional art, and also capable of being easily manufactured, installed and maintained, and a ship having the same.

Also, the present invention is directed to providing a propulsion device for a ship which is capable of, if necessary, cutting off power transmission to a counter rotation unit, and a ship having the same.

Also, the present invention is directed to providing a propulsion device for a ship which is capable of protecting the counter rotation unit when propulsive force is acquired with only a rear propeller, and a ship having the same.

Also, the present invention is directed to providing a propulsion device for a ship which is capable of automatically cutting off the power transmission to the counter rotation unit, and a ship having the same.

Technical Solution

One aspect of the present invention provides a propulsion device including a rotational shaft, a rear propeller fixed to the rotational shaft, a front propeller rotatably supported by the rotational shaft in front of the rear propeller, a counter rotation unit disposed in an installation space of a stern of a ship body and including a plurality of gears configured to reverse rotation of the rotational shaft and transmit the reversed rotation to the front propeller and a gear box configured to receive the plurality of gears, a coupling unit configured to separably connect the rotational shaft with the counter rotation unit and cut off power transmission from the rotational shaft to the counter rotation unit upon disconnection therebetween, and a rotation preventing unit configured to prevent rotation of the front propeller when the coupling unit is separated.

The coupling unit may include a friction member disposed between the rotational shaft and the counter rotation unit to prevent slippage.

The coupling unit may include a driving flange formed in a radial direction of the rotational shaft, and a plurality of connection bolts configured to pass through the driving flange and couple the rotational shaft with the counter rotation unit.

The friction member may be formed into a plurality of pieces which are allowed to be separated between the rotational shaft and the counter rotation unit, when the bolts are separated.

The plurality of gears may include a driving bevel gear, a driven bevel gear configured to transmit power to the front propeller, one or more reverse bevel gears configured to reverse rotation of the driving bevel gear and transmit the reversed rotation to the driven bevel gear, and a first connection member connected with the driving bevel gear to extend toward the driving flange.

The coupling unit may further include a driven flange configured to extend from the counter rotation unit and receive a driving force of the rotational shaft, and the rotation preventing unit comprises a shaft configured to fix the driven flange to the ship body.

The driven flange may include a fastening hole to which one end of the shaft is fixed, and the ship body may include a shaft frame to which the other end of the shaft is fixed.

The rotation preventing unit may restrict rotation of the first connection member, when a connection between the first connection member and the driving flange is released.

The coupling unit may further include a driven flange configured to extend from the counter rotation unit and receive driving force of the rotational shaft, and the rotation preventing unit may include a disc brake having a pair of friction pads disposed at both sides of an edge portion of the driven flange to face each other.

The coupling unit may include a first gear unit fixed to the rotational shaft, a second gear unit fixed to the counter rotation unit, and connection unit configured to selectively connect the first gear unit with the second gear unit.

The second gear unit may include a cylindrical portion coupled to the counter rotation unit, and a second gear portion disposed at an end of the cylindrical portion to be adjacent to a first gear portion of the first gear unit.

The connection unit may include a forward and backward movement unit provided at an outer diameter of the cylindrical portion to be axially slid along the cylindrical portion, and a connection gear part configured to extend from the forward and backward movement unit and correspond to the first and second gear portions.

The clutch unit may include a hydraulic chamber partitioned between the forward and backward movement unit and the second gear unit and configured to receive a fluid to allow the forward and backward movement unit to be slid.

The clutch unit may include a fluid passage configured to supply a fluid to the hydraulic chamber.

The plurality of gears may include a driving bevel gear, a driven bevel gear configured to transmit power to the front propeller, and one or more reverse bevel gears configured to reverse rotation of the driving bevel gear and transmit the reversed rotation to the driven bevel gear, and the second gear unit may be connected with the driving bevel gear to extend toward the first gear unit.

Advantageous Effects

In the propulsion device according to the embodiment of the present invention, the front connection member is separably coupled with the rotational shaft, and thus the power transmission to the counter rotation unit can be cut off, when an emergency state such as the breakdown of the counter rotation unit occurs.

Also, in the propulsion device according to the embodiment of the present invention, when the power transmission to the counter rotation unit is cut off, the rotation preventing unit which prevents the rotation of the front propeller is provided, and thus the damage to the constituent elements such as the counter rotation unit, which may occur due to the rotation of the front propeller, can be prevented.

Also, in the propulsion device according to the embodiment of the present invention, since the counter rotation unit is manufactured and assembled at an outer side of the ship body, and then the gear box of the counter rotation unit is installed to be inserted into the installation space formed at the stern of the ship body, the counter rotation unit can be easily manufactured and installed.

Also, in the propulsion device according to the embodiment of the present invention, when the breakdown occurs, the front and rear propellers can be separated from the rotational shaft, and the gearbox of the counter rotation unit can be also separated from the ship body, and thus maintenance work thereof, such as repair, can be easily performed.

Also, in the propulsion device according to the embodiment of the present invention, since the clutch unit which automatically implements the coupling and separating between the counter rotation unit and the rotational shaft is provided, the power transmission or cut-off to the counter rotation unit can be automated.

Also, in the propulsion device according to the embodiment of the present invention, when the power transmission to the counter rotation unit is cut off, the rotation preventing unit which prevents the rotation of the front propeller is provided, and thus the construction elements such as the counter rotation unit can be prevented from being damaged by the rotation of the front propeller.

Also, in the propulsion device according to the embodiment of the present invention, since the rotation of the front propeller is reversed using the plurality of reverse bevel gears, the volume there can be reduced, compared with the conventional planetary gear type counter rotation unit, and configuration of the power transmission system can be simplified. Further, since the volume of the counter rotation unit can be reduced, the counter rotation unit can be installed at the stern of the ship body.

Also, in the propulsion device according to the embodiment of the present invention, since the counter rotation unit is installed at the stern of the ship body, and thus a conventional hollow shaft can be excluded, the power transmission system can be simplified, compared with the conventional one, and an area in which lubrication is required can be reduced, and various problems due to the lubrication can be minimized.

MODES OF THE INVENTION

Hereinafter, exemplary embodiments of the present invention will be described in detail with reference to the accompanying drawings.

Figure 1:
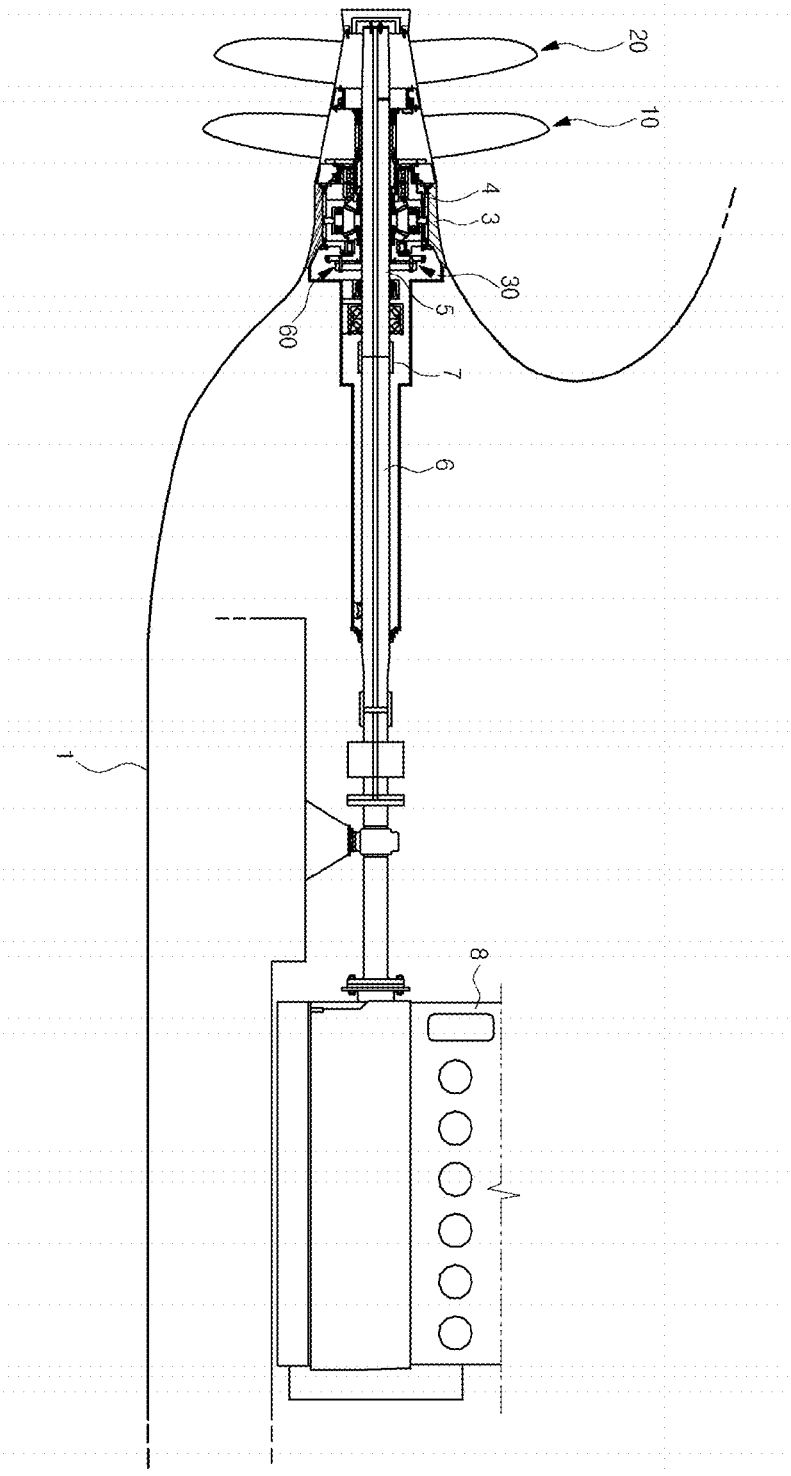
FIG. 1 is a cross-sectional view illustrating a state in which a propulsion device according to an embodiment of the present invention is applied to a ship.

FIG. 1 is a cross-sectional view illustrating a state in which a propulsion device according to an embodiment of the present invention is applied to a ship.

As illustrated in FIG. 1, the propulsion device according to the embodiment of the present invention includes a rotational shaft 5, a front propeller 10 and a rear propeller 20 disposed at the rotational shaft 5 of a rear side of a ship body 1 so that axial lines thereof coincide with each other, a counter rotation unit 30 installed at a stern 3 of the ship body 1 to implement counter rotation of the front propeller 10 and the rear propeller 20, and a coupling unit 60 which separably connects the rotational shaft 5 with the counter rotation unit 30. The embodiment is a counter rotating propeller (CRP) type propulsion device in which the two propellers 10 and 20 generate propulsive force via counter rotation thereof.

Here, the stern 3 of the ship body 1 is a stern boss which is formed in a streamlined shape to protrude from the ship body 1 toward the rear side thereof and to install the front and rear propellers 10 and 20 and the counter rotation unit 30. The stern 3 of the ship may be manufactured by a casting operation and then fixed to the ship body 1 by a welding operation. Further, an installation space 4 formed to pass back and forth through the stern of the ship body and to receive the counter rotation unit 30 is provided. An inner surface of the installation space 4 may be machined in a cylindrical shape by a boring operation to correspond to an exterior shape of the counter rotation unit 30.

A front end of the rotational shaft 5, which protrudes to a front side of the counter rotation unit 30, may be separably connected with a main driving shaft 6 disposed in the ship body 1. The main driving shaft 6 is connected with a driving source 8 (an engine, a motor, a turbine or the like) installed in the ship body 1, and thus the rotational shaft 5 may be rotated with the main driving shaft 6.

The main driving shaft 6 and the rotational shaft 5 may be separably connected with each other by a cylindrical coupling unit 7. Here, as an example, the coupling unit is provided, but a connection manner between the main driving shaft 6 and the rotational shaft 5 is not limited thereto. A flange coupling type, a friction clutch type, a magnetic clutch type, or the like may be selectively used.

Figure 2:
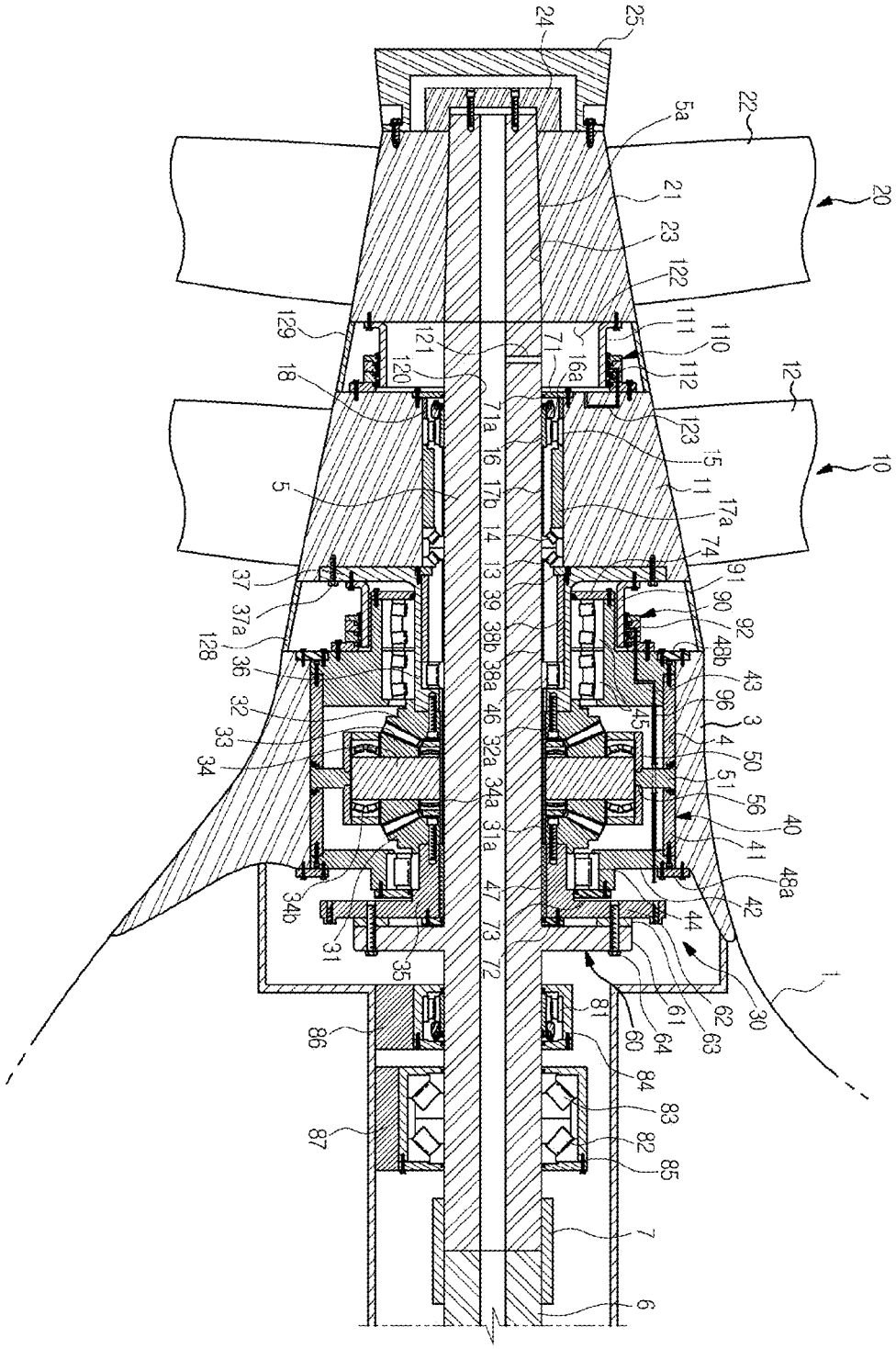
FIG. 2 is a cross-sectional view of the propulsion device according to the embodiment of the present invention.
Figure 3:
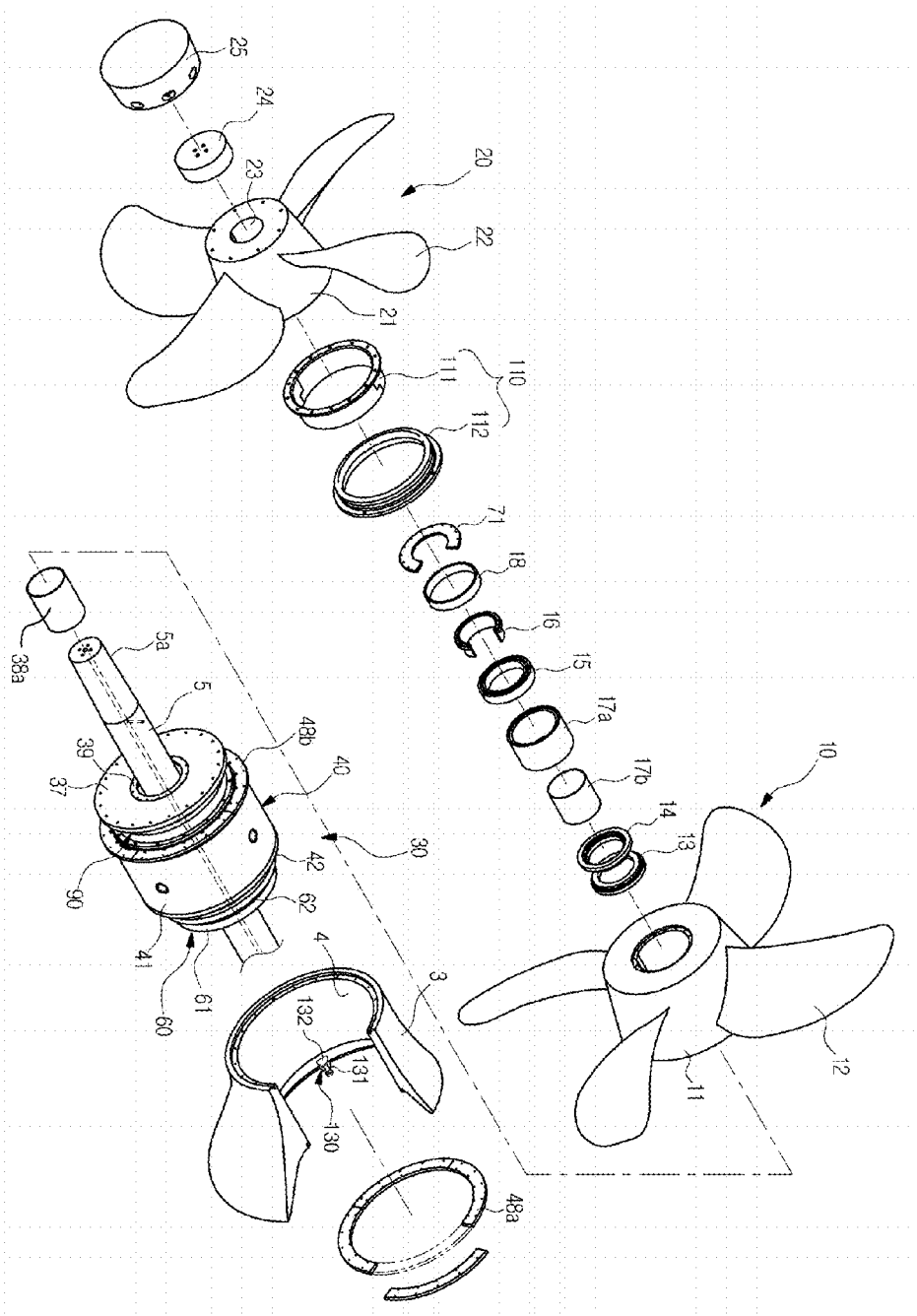
FIG. 3 is an exploded perspective view of the propulsion device according to the embodiment of the present invention.
Figure 4:
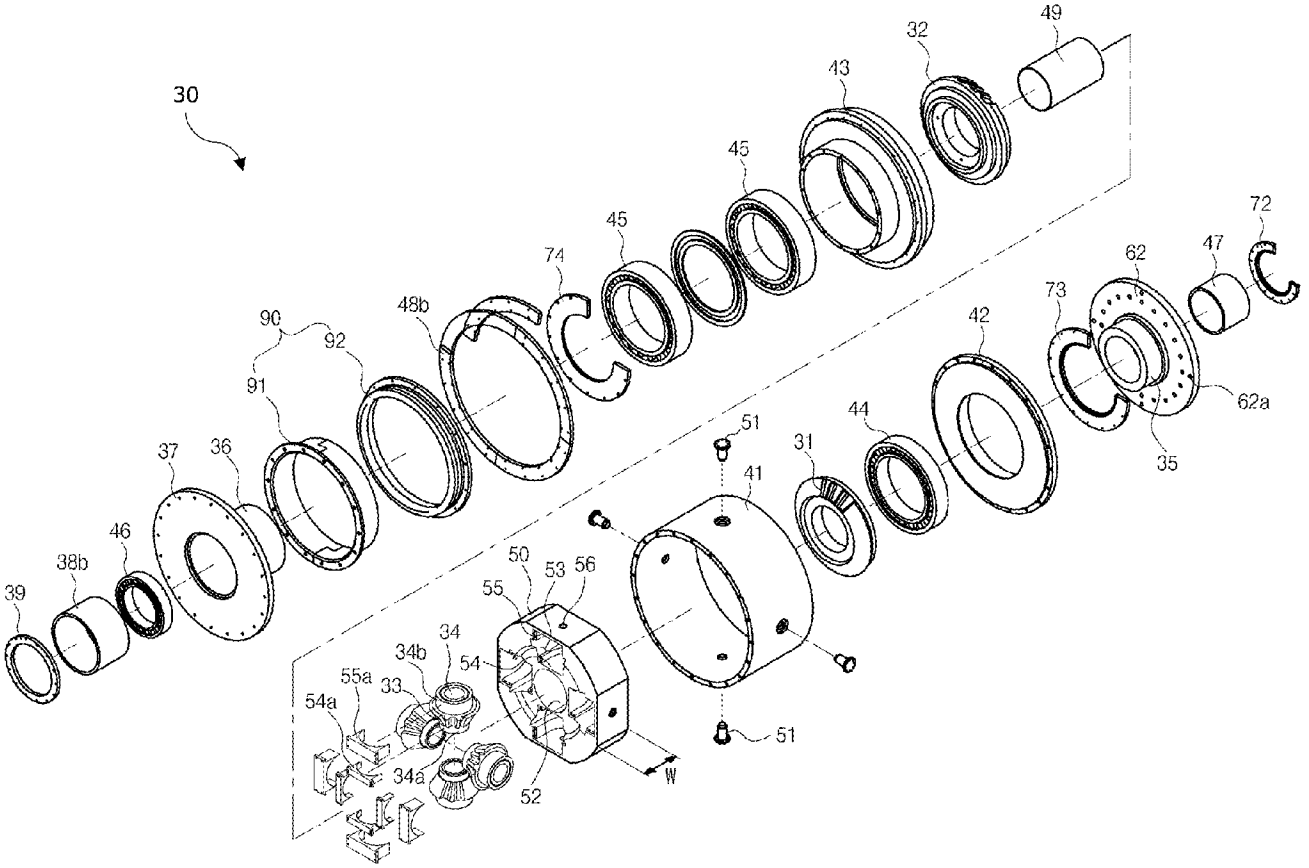
FIG. 4 is an exploded perspective view of a counter on unit of the propulsion device according to the embodiment of the present invention.

FIG. 2 is a cross-sectional view of the propulsion device according to the embodiment of the present invention, FIG. 3 is an exploded perspective view of the propulsion device according to the embodiment of the present invention, and FIG. 4 is an exploded perspective view of a counter rotation unit of the propulsion device according to the embodiment of the present invention.

As illustrated in FIGS. 2 and 3, the front propeller 10 is rotatably installed at an outer surface of the rotational shaft 5 between the rear propeller 20 and the counter rotation unit 30. The front propeller 10 includes a huh 11 which is rotatably supported by the outer surface of the rotational shaft 5, and a plurality of blades 12 provided at the outer surface of the hub 11. The front propeller 10 may be installed at the rotational shaft 5, before the rear propeller 20 is installed. Further, since the front propeller 10 is rotated in an opposite direction to a rotating direction of the rear propeller 20, a blade angle thereof is formed to be opposite to that of the rear propeller 20.

The rear propeller 20 is fixed to a rear portion 5*a* of the rotational shaft 5 to be rotated with the rotational shaft 5. The rear propeller 20 includes a hub 21 fixed to the rotational shaft 5, and a plurality of blades 22 provided at an outer surface of the hub 21. The hub 21 of the rear propeller 20 may be fixed to the outer surface of the rotational shaft 5 in a press-fitting manner in which a shaft coupling hole 23 formed at a center thereof is press-fitted to the outer surface of the rotational shaft 5. A fixing cap 24 may be coupled to a rear end of the rotational shaft 5, and thus the rear propeller 20 may be more firmly fixed to the rotational shaft 5. For such a coupling, the rear portion 5*a* of the rotational shaft 5 may be formed to have a tapered outer surface, such that an outer diameter thereof is gradually reduced toward a rear side thereof, and the shaft coupling hole 23 of the hub 21 may be formed to have a tapered inner surface corresponding to the outer surface of the rotational shaft 5. In FIG. 2, a reference numeral 25 is a propeller cap which is installed at the hub 21 to cover the fixing cap 24 and a rear surface of the hub 21 of the rear propeller 20.

As illustrated in FIGS. 2 to 4, the counter rotation unit 30 includes a gear box 40 which forms an exterior and is received in the installation space 4 of the stern 3 of the ship body 1, a driving bevel gear 31 which is installed in the gear box 40 to be rotated with the rotational shaft 5, a driven bevel gear 32 which is rotatably supported by the rotational shaft 5 in the gear box 40 to be opposed to the driving bevel gear 31, and at least one reverse bevel gear 33 which reverses rotation of the driving bevel gear 31 and transmits reversed rotation to the driven bevel gear 32. Further, the counter rotation unit 30 may further include a first connection member 35 which connects the rotational shaft 5 with the driving bevel gear 31, and a second connection member 36 which connects the driven bevel gear 32 with the hub 11 of the front propeller 10. The rotational shaft 5 and the driving bevel gear 31, and the driven bevel gear 32 and the hub 11 of the front propeller 10 may be directly connected with each other without the first and second connection members 35 and 36.

The gear box 40 receives the driving bevel gear 31, the driven bevel gear 32 and the reverse bevel gear 33, and thus the counter rotation unit 30 may be formed as one unit. The rear propeller 20 is fixed to the rotational shaft 5 which extends to a rear side of the gear box 40, and the front propeller 10 is rotatably supported by the outer surface between the rear propeller 20 and the gear box 40.

The front propeller 10 may be connected with the counter rotation unit 30, and thus rotated in the opposite direction to the rotating direction of the rear propeller. Hereinafter, the front propeller 10 will be described in detail.

Figure 5:
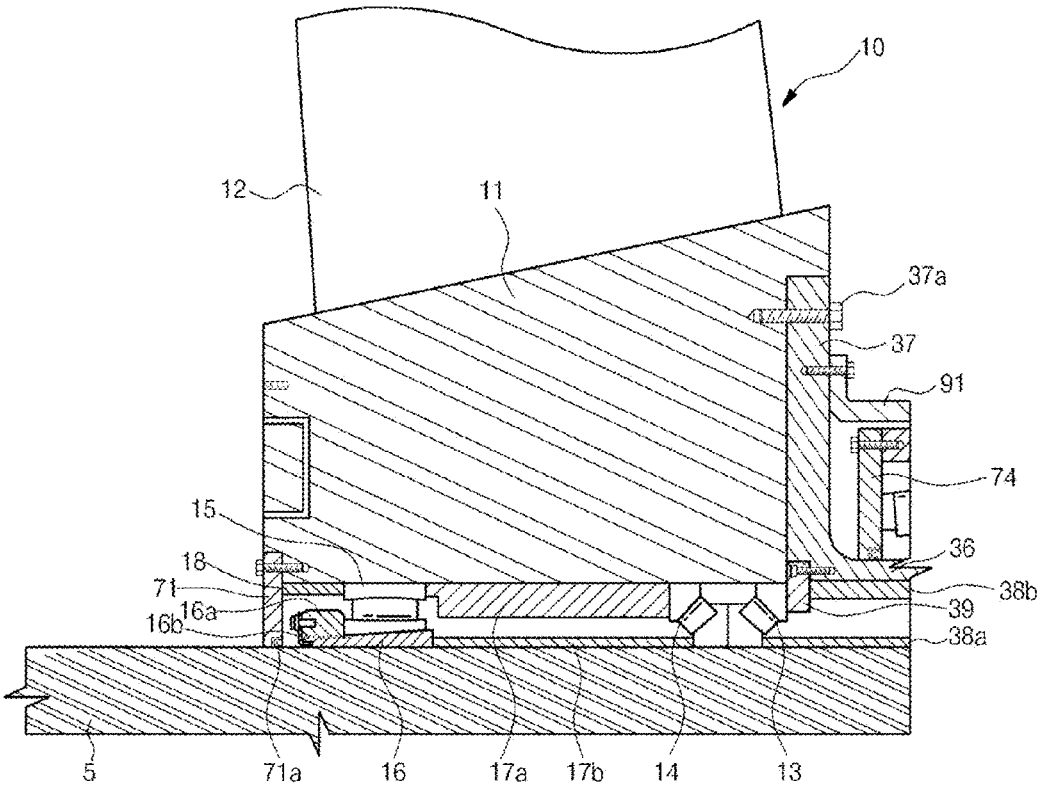
FIG. 5 is a detailed cross-sectional view illustrating an installation structure of bearings supporting a front propeller of the propulsion device according to the embodiment of the present invention.

FIG. 5 is a detailed cross-sectional view illustrating an installation structure of bearings supporting a front propeller of the propulsion device according to the embodiment of the present invention.

As illustrated in FIGS. 2 and 5, the hub 11 of the front propeller 10 may be rotatably supported by the outer surface of the rotational shaft 5 via a first thrust bearing 13, a second thrust bearing 14 and a first radial bearing 15. The first and second thrust bearings 13 and 14 may be installed between a front inner surface of the hub 11 and the outer surface of the rotational shaft 5, and the first radial bearing 15 may be installed between a rear inner surface of the hub 11 and the outer surface of the rotational shaft 5.

The first radial bearing 15 may bear a radial load of the front propeller 10 applied in a radial direction of the rotational shaft 5, and the first and second thrust bearings 13 and 14 may bear thrust loads respectively applied in front and rear axial directions of the rotational shaft 5. Specifically, the second thrust bearing 14 may bear the thrust load applied from the front propeller 10 to a stern side, when a ship moves forward, and the first thrust bearing 13 may bear the thrust load applied from the front propeller 10 to a stern side, when a ship moves backward.

As illustrated in FIG. 5, an inner race of the first thrust bearing 13 and an inner race of the second thrust bearing 14 may be arranged to be press-fitted to the outer surface of the rotational shaft 5 and to be in contact with each other, and thus may be supported so as not to be axially pushed. An outer race of the first thrust may be supported by a fixing ring 39 installed at the second connection member 36 coupled with the hub 11, and thus may not be axially pushed.

First and second cylindrical support rings 17*a* and 17*b* may be installed between the rotational shaft 5 and the hub 11 of the front propeller 10, such that the second thrust bearing 14 is not axially pushed. The first support ring 17*a* is disposed between the outer race of the second thrust bearing 14 and the outer race of the first radial bearing 15 so that they are supported with respect to each other, and the second support bearing 17*b* is disposed between the inner race of the second thrust bearing 14 and the inner race of the first radial bearing 15 so that they are supported with respect to each other. Also, a gap adjusting ring 18 may be installed between the outer race of the first radial bearing 15 and a first sealing cover 71 to be described later, such that the outer race of the first radial bearing 15 is not axially pushed. Here, the gap adjusting ring 18 is installed so as to more stably support the outer race of the first radial bearing 15. However, when the outer race of the first radial bearing 15 is press-fitted into the inner surface of the hub 11, the outer race of the first radial bearing 15 may be fixed, even though the gap adjusting ring 18 is not provided, and thus the gap adjusting ring 18 may be selectively used.

As illustrated in FIG. 5, a cylindrical wedge member 16 may be installed between the outer surface of the rotational shaft 5 and the inner race of the first radial bearing 15, and thus the inner race of the first radial bearing 15 may be fixed so as not to be axially pushed. The wedge member 16 may have a tapered outer surface so that an outer diameter thereof is gradually reduced toward a rear side thereof, and a screw thread formed at a rear outer surface thereof, and an inner surface thereof may be press-fitted and fixed into the outer surface of the rotational shaft 5. And a fastening nut 16*a* may be fastened to the screw thread formed at the rear side, and thus the inner race of the first radial bearing 15 may be restricted. Therefore, the first radial bearing 15 may be firmly fixed between the outer surface of the rotational shaft 5 and the inner surface of the hub 11. A loose-proof fixing clip 16*b* may be fastened to the wedge member 16 and the fastening nut 16*a*.

Figure 6:
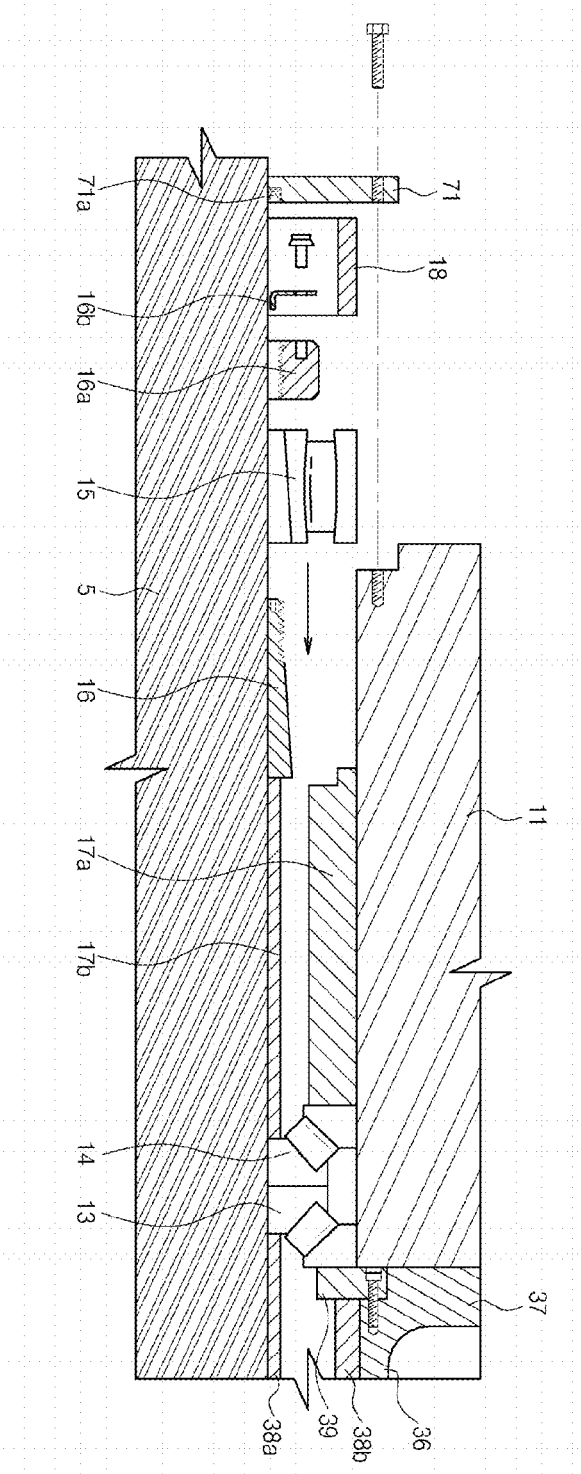
FIG. 6 is a detailed cross-sectional view illustrating the installation structure of the bearings supporting the front propeller of the propulsion device according to the embodiment of the present invention, wherein a first radial bearing is separated.

FIG. 6 is a detailed cross-sectional view illustrating the installation structure of the bearings supporting the front propeller of the propulsion device according to the embodiment of the present invention, wherein the first radial bearing is separated.

First, when the front propeller 10 is installed, the first thrust bearing 13, the second thrust bearing 14, the first and second support rings 17*a*, 17*b* and the wedge member 16 may be installed, in turn, at the outer surface of the rotational shaft 5. And as illustrated in FIG. 6, the hub 11 of the front propeller 10 may be coupled to an outer side of the rotational shaft 5, such that the inner surface of the hub 11 is coupled to the outer races of the first and second thrust bearings 13 and 14. Then, the first radial bearing 15 may be pushed in and installed between an outer surface of the wedge member 16 and the inner surface of the hub 11, and the fastening nut 16*a* may be fastened to the wedge member 16 so as to fix the inner race of the first radial bearing 15. After the first radial bearing 15 is installed, the gap adjusting ring 18 may be installed, and then the first sealing cover 71 may be installed.

As described above, if the first radial bearing 15 is fixed using the wedge member 16, even when an installation position of the first radial bearing 15 is changed due to a manufacturing tolerance of a component such as the first and second support rings 17*a* and 17*b*, a coupling error may be compensated by adjusting installation positions of the first radial bearing 15 and the wedge member 16. That is, since the first radial bearing 15 may be fixed in a state in which the first radial bearing 15 and the wedge member 16 are pushed to the first and second support rings 17*a* and 17*b* side, it is possible to minimize the coupling error among the components. In a state in which the first radial bearing 15 is installed, a distance between the outer race of the first radial bearing 15 and the first sealing cover 71 may be measured, and then the gap adjusting ring 18 may be manufactured and installed to correspond to the measured distance.

When the front propeller 10 is separated from the rotational shaft 5 to execute repair or the like, the first sealing cover 71 and the gap adjusting ring 18 are conversely separated, the fastening nut 16*a* fastened to the wedge member 16 is released so as to separate the first radial bearing 15, and then the front propeller 10 may be pulled and separated toward the rear side. After the front propeller 10 is separated, the first and second thrust bearings 13 and 14, the wedge member 16 and the first and second support rings 17*a* and 17*b* are exposed, and thus they may be easily separated.

Figure 7:
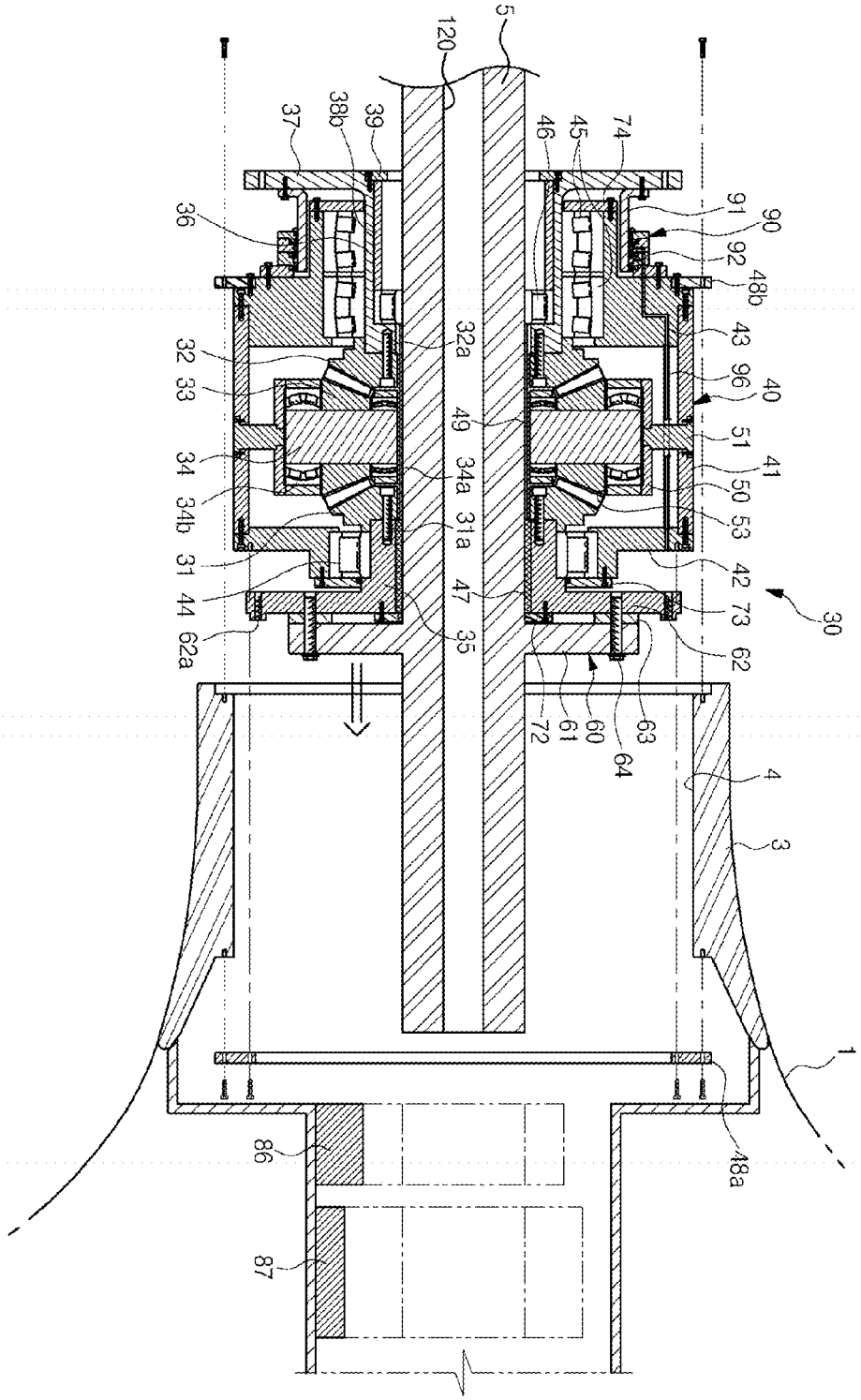
FIG. 7 is a cross-sectional view illustrating an installation example of the counter rotation unit of the propulsion device according to the embodiment of the present invention, wherein the counter rotation unit is separated.

FIG. 7 is a cross-sectional view illustrating an installation example of the counter rotation unit of the propulsion device according to the embodiment of the present invention, wherein the counter rotation unit is separated.

As illustrated in FIGS. 4 and 7, the gear box 40 of the counter rotation unit 30 may include a cylindrical body 41 in which the driving bevel gear 31, the driven bevel gear 32 and a plurality of reverse bevel gears 33 are received and of which both ends are opened, a front cover 42 which is coupled with the body 41 to close a front side opening of the body 41, and a rear cover 43 which is coupled with the body 41 to close a rear side opening of the body 41.

The front cover 42 may rotatably support the first connection member 35 passing through a center portion thereof, and the rear cover 43 may also rotatably support the second connection member 36 passing through a center portion thereof. To this end, a front bearing 44 may be installed between an outer surface of the first connection member 35 and the front cover 42, and a rear outer bearing 45 may be installed between an outer surface of the second connection member 36 and the rear cover 43.

A plurality of rear outer bearings 45 may be continuously installed in a lengthwise direction of the rotational shaft 5, and thus the second connection member 36 may be stably supported and rotated. A rear inner bearing 46 may be installed between an inner surface of the second connection member 36 and the rotational shaft 5 to rotatably support the second connection member 36, and a cylindrical sleeve bearing 47 may be installed between the first connection member 35 and the outer surface of the rotational shaft 5. Further, a cylindrical space ring 49 may be installed at the outer surface of the rotational shaft 5 between an inner race of the rear inner bearing 46 and the sleeve bearing 47 to support them.

All of the front bearing 44, the rear outer bearing 45 and the rear inner bearing 46 may be configured with the radial bearings. The bearings 44, 45 and 46 may support the radial load applied to the rotational shaft 5, the first connection member 35 and the second connection member 36, and may allow stable rotation thereof.

The driving bevel gear 31 is connected with the first connection member 35 by fastening a plurality of fixing bolts 31*a* so as to be rotated with the first connection member 35. Also, the driven bevel gear 32 is connected with the second connection member 36 by fastening a plurality of fixing bolts 32*a*. When the driven bevel gear 32 is rotated, an inner diameter portion of the driven bevel gear 32 may be spaced from the rotational shaft 5 to avoid interference with the rotational shaft 5.

The plurality of reverse bevel gears 33 are disposed between the driving bevel gear 31 and the driven bevel gear 32 to be engaged therewith, respectively. A shaft 34 supporting each reverse bevel gear 33 is disposed in a direction (a radial direction of the rotational shaft) crossing the rotational shaft, and a plurality of shafts 34 may be radially disposed around the rotational shaft 5. Further, bearings 34*a* and 34*b* may be installed at both ends of the shaft 34 of each reverse bevel gear 33 to smoothly rotate the shaft 34.

An inner frame 50 may be installed in the gear box 40 to install the reverse bevel gears 33. The inner frame 50 may be fixed in the body 41 by fastening a plurality of fixing members 51, while being inserted into the gear box 40.

As illustrated in FIG. 4, the inner frame 50 may have a through hole 52 which is formed a center portion thereof and through which the rotational shaft 5 passes, and may be formed in a cylindrical shape or a polyprism shape of which a width W (in the lengthwise direction of the rotational shaft) is smaller than a maximum outer diameter of the reverse bevel gear 33. The inner frame 50 include a plurality of gear installation portions 53 which rotatably receive each reverse bevel gear 33 and of which both sides are opened so that the reverse bevel gear 33 may be engaged with the driving and driven bevel gears 31 and 32. Further, the inner frame 50 include a first shaft supporting portion 54 and a second shaft supporting portion 55 which are provided to support the bearings 34*a* and 34*b* installed at the both ends of the shaft 34 of the reverse bevel gear 33. A plurality of these structures may be radially disposed around the through hole 52 to install the plurality of reverse bevel gears 33.

The first and second shaft supporting portions 54 and 55 may be provided so as to be opened in a direction of one side surface of the inner frame 50 and thus to install the shaft 34 of the reverse bevel gear. Here, a first fastening member 54*a* and a second fastening member which cover and fix the bearings 34*a* and 34*b* may be installed. Therefore, when each reverse bevel gear 33 is installed in the inner frame 50, the reverse bevel gear 33, the shaft 34 of the reverse bevel gear and the bearings 34*a* and 34*b* may be assembled, and this assembly may be inserted and installed from the direction of the one side surface of the inner frame 50 into the gear installation portion 53, and then the first and second fastening members 54*a* and 55*a* may be fastened. This is merely an example of a method of installing the reverse bevel gears 33 in the inner frame 50, and the installing method of the reverse bevel gears 33 is not limited thereto. When a shape of the inner frame 50 is changed, the installing method of the reverse bevel gears 33 may be also changed.

In an assembling process of the counter rotation unit 30, the inner frame 50 in which the reverse bevel gears 33 are installed may be inserted into the body 41 of the gear box 40, before the driving bevel gear 31, the driven bevel gear 32, the front cover 42 and the rear cover 43 are installed, and then may be fixed in the body 41 by fastening the plurality of fixing members 51.

As illustrated in FIGS. 4 and 7, the plurality of fixing members 51 may be provided in cylindrical pin shapes. The fixing member 51 may be installed to pass through the body 41 from an outer side of the body 41 and to be inserted into the body 41, and thus an inner end thereof may fixedly support the inner frame 50. The inner end of the fixing member 51 may be inserted into a fixing hole 56 formed around the inner frame 50, and thus the inner frame 50 may be bound. An outer end of the fixing member may be fixed to the body 41 by fastening a fixing screw.

According to the gear box 40, after the reverse bevel gear assembly including the inner frame 50 is installed in the body 41, the driving bevel gear 31 and the driven bevel gear 32 may be installed through openings formed in both sides of the body 41, and then the components such as the front cover 42, the rear cover 43, the first connection member 35 and the second connection member 36 may be installed. Therefore, the counter rotation unit 30 may be easily assembled, and a future repair may be easily carried out.

In the embodiment, the counter rotation unit 30 has the plurality of reverse bevel gears 33. However, as long as the reverse bevel gear 33 may reverse the rotation of the driving bevel gear 31 and then transmit the reversed rotation to the driven bevel gear 32, the plurality of reverse bevel gears 33 does not have to be necessarily provided. A small ship having a relatively small driven load may perform its own function with only one reverse bevel gear.

Figure 8:
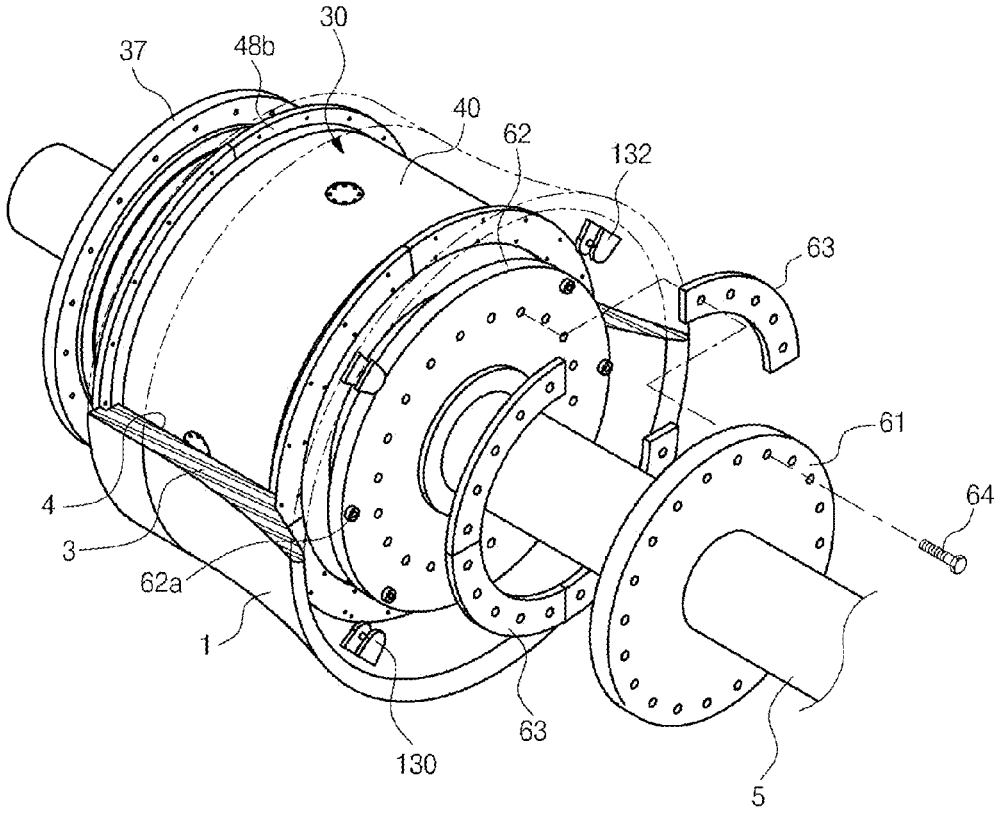
FIG. 8 is a view illustrating a state in which the counter rotation unit is coupled with a rotational shaft in the propulsion device according to the embodiment of the present invention.
Figure 12:
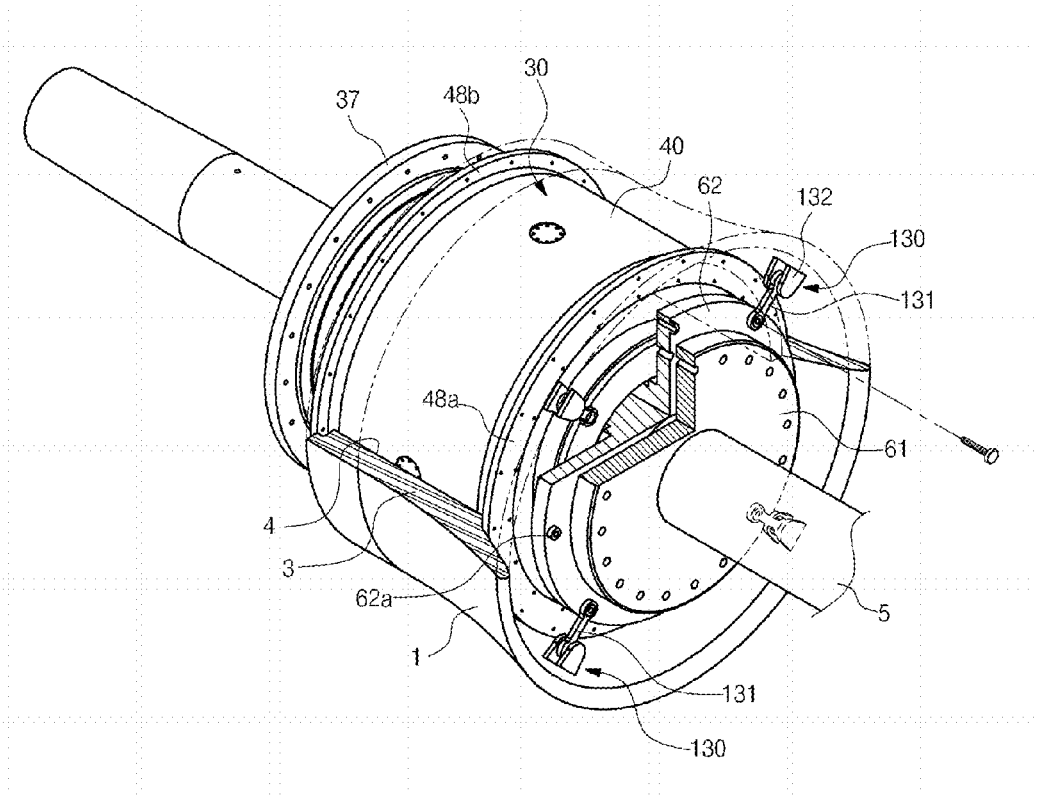
FIG. 12 is a perspective view illustrating a state in which the rotation preventing unit is installed at a stern of a ship according to the embodiment of the present invention.

FIG. 8 is a view illustrating a state in which the counter rotation unit is coupled with the rotational shaft in the propulsion device according to the embodiment of the present invention, and FIG. 12 is a perspective view illustrating a state in which a rotation preventing unit is installed at the stern of the ship according to the embodiment of the present invention.

In the embodiment, as illustrated in FIGS. 7, 8 and 12, the coupling unit 60 which separably connects the rotational shaft 5 with the counter rotation unit 30 is provided. The coupling unit 60 may include a driving flange 61 which is provided at the rotational shaft 5 located at a front side of the gear box 40, a driven flange 62 which is provided at the first connection member 35 to face the driving flange 61, a friction member 63 which is disposed between the driving flange 61 and the driven flange 62, and a plurality of connection bolts 64 which pass through and fasten them.

The driving flange 61 may be integrally formed with the rotational shaft 5, or may be separately manufactured and then fixed to the rotational shaft 5 by a welding operation or the like.

The driven flange 62 may be separately or integrally provided from/with the first connection member 35, may have a larger diameter than that of the driving flange 61 to be easily coupled with a rotation preventing unit 130 to be described later, and may have fastening holes 62*a* for coupling with the rotation preventing unit 130, which are formed at an outer circumferential end thereof in a circumferential direction so as to be spaced at a predetermined interval.

The friction member 63 is disposed between the rotational shaft 5 and the counter rotation unit 30 to prevent a slip therebetween, passed through by the connection bolt 64, and fixed between the driving flange 61 and the driven flange 62. As illustrated in FIG. 8, the friction member 63 is formed into a plurality of pieces so as to be separated toward an outer side when the coupling unit 60 is separated. When the coupling unit 60 is separated, the connection bolt 64 may be released and removed, and then the pieces of the friction member 63 may be radially separated toward the outer side.

When necessary, the coupling unit 60 may cut off power connection between the driving flange 61 and the driven flange 62 by releasing the plurality of connection bolts 64 and separating the friction member 63. For example, when the counter rotation unit 30 breaks down, while the ship runs, power transmission from the rotational shaft 5 to the first connection member 35 may be cut off. In this case, the ship may run with only an operation of the rear propeller 20.

At this time, when the ship runs with the operation of the rear propeller 20, the front propeller 10 is rotated by water streams generated according to movement of the ship. When the front propeller 10 is rotated, the plurality of gears 31, 32 and 33 engaged with the front propeller 10 are also rotated. If the plurality of gears 31, 32 and 33 are rotated in the state in which the counter rotation unit 30 breaks down, damage to each component such as the gear may be intensified, and thus it is required to restrict rotation of the front propeller 10.

To this end, the embodiment has the rotation preventing unit 130 which prevents the rotation of the front propeller 10, when the coupling unit 60 is separated.

Figure 9:
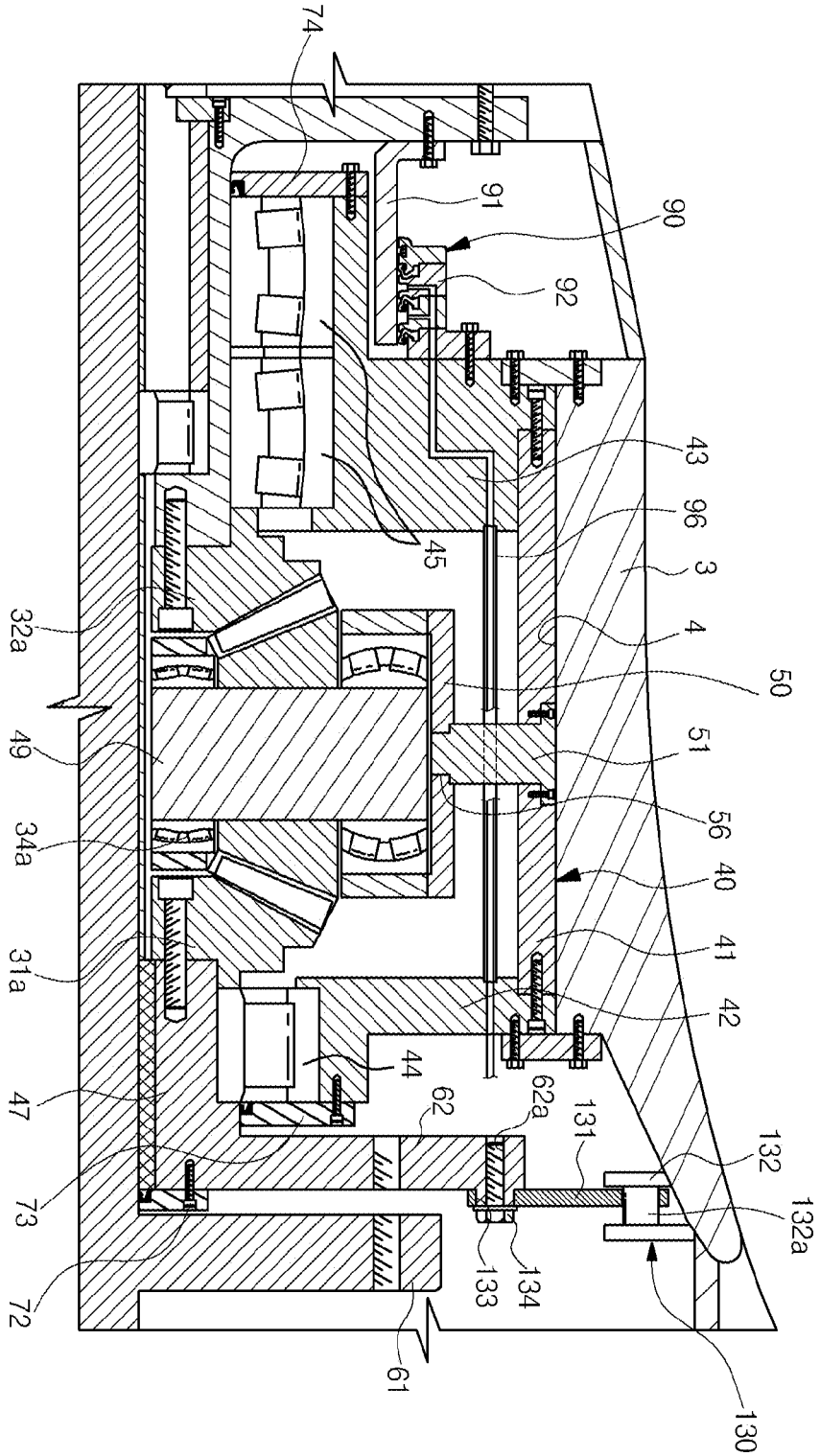
FIG. 9 is a cross-sectional view illustrating a state in which a coupling unit is separated and then a rotational preventing unit is installed in the propulsion device according to the embodiment of the present invention.

FIG. 9 is a cross-sectional view illustrating a state in which the coupling unit is separated and then the rotational preventing unit is installed in the propulsion device according to the embodiment of the present invention.

Referring to FIGS. 9 and 12, to restrict rotation of the driven flange 62 at a front side of the stern 3 of the ship body, one end of the rotation preventing unit 130 is supported by the ship body 1, and the other end thereof may include at least one or more shafts 131 supported by the driven flange 62.

The at least one or more shafts 131 may be disposed at for places spaced at regular intervals in a circumferential direction of the driven flange 62. One end of each shaft 131 is rotatably supported by a shaft frame 132 installed at the stern 3 of the ship body, and the other end thereof may be coupled and fixed by a bolt fastened into the fastening hole 62*a* of the driven flange 62.

As described in the embodiment, for convenience of the screw-coupling with the other end of each shaft 131, the driven flange 62 may be formed to have a larger diameter than that of the driving flange 61 and also to have the separate fastening holes 62*a* formed at an outer circumference side thereof. However, the other end of the shaft 131 may be coupled using the hole from which the connection bolt 64 is removed after the coupling unit 60 is separated. At this time, the diameters of the driven flange 62 and the driving flange 61 may be formed to be the same as each other. One end of each shaft 131 may be rotatably supported by a shaft 132*a* of the shaft frame 132, and the other end thereof may have bolt holes 133 for fastening of bolts together with the fastening holes 62*a* of the driven flange 62.

When the counter rotation unit 30 breaks down, and thus the power connection between the driving flange 61 and the driven flange 62 is cut off, an operator couples one end of each shaft 131 provided from an inner side of the ship body 1 toward the front side of the stern 3 of the ship body with the shaft frame 132, and fixes the other end thereof to the fastening hole 62*a* of the driven flange 62 by fastening the bolt 134. Therefore, the gears of the counter rotation unit 30 are prevented from being additionally damaged by the rotation of the front propeller 10.

Meanwhile, in the rotation preventing unit 130 of the embodiment, the driven flange 62 is manually restricted by the operator. Of course, the rotation preventing unit 130 may move forward and backward a friction pad (not shown) through an electronic control hod or a hydraulic control method, and thus may automatically restrict or release the driven flange 62.

Figure 13:
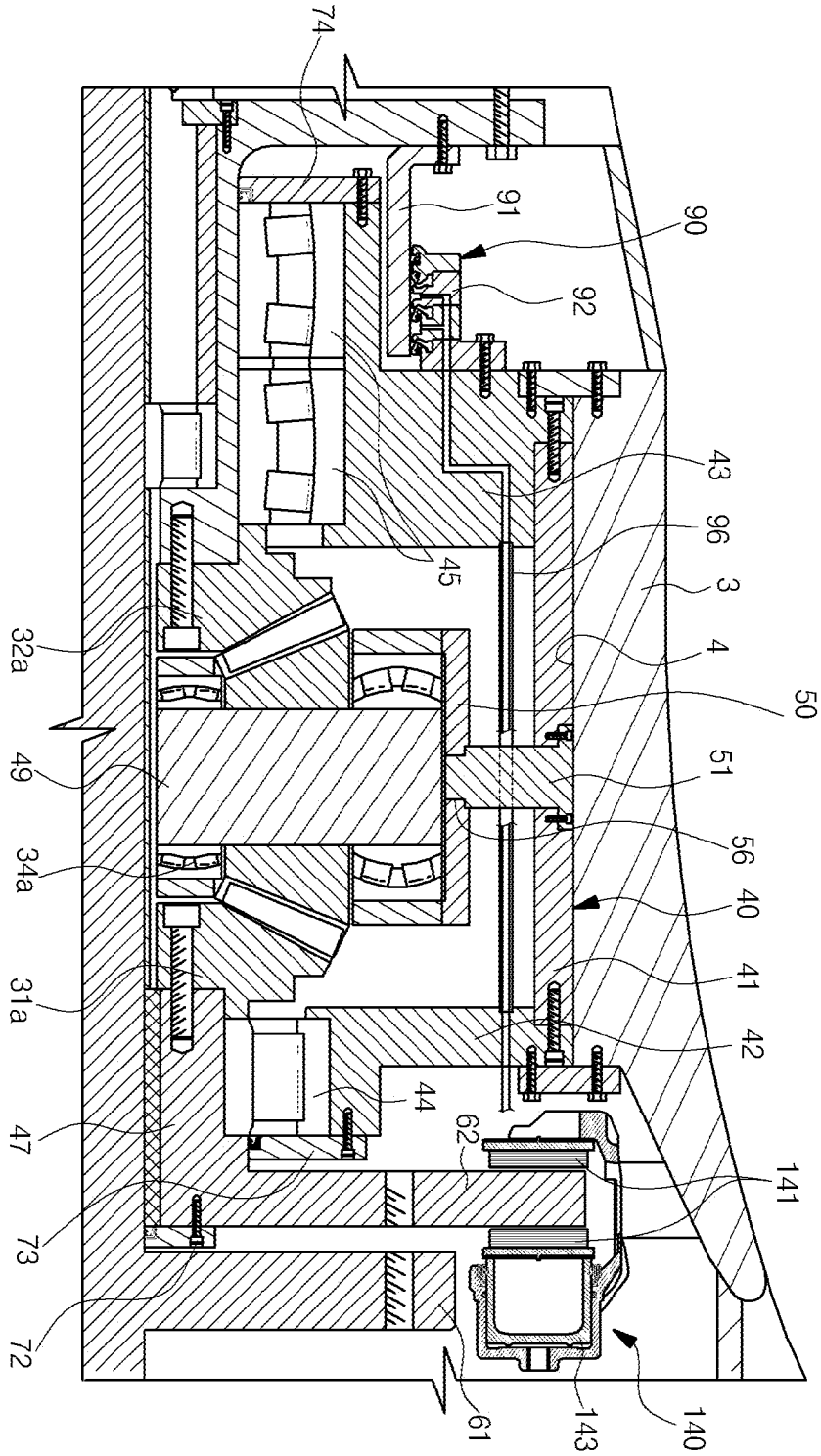
FIG. 13 is a cross-sectional view illustrating a state in which the rotation preventing unit according to the embodiment of the present invention is installed.

As an example, as illustrated in FIG. 13, a rotation preventing unit 140 may be provided in a disk brake type which is installed around the stern 3 of the ship body corresponding to the driven flange 62.

The disc brake is a brake system in which a pad is attached to both surfaces of a disc to obtain braking force through friction. The rotation preventing unit 140 of the embodiment may include a pair of friction pads 141 which are disposed to be spaced at both sides around an edge portion of the driven flange 62 protruding more than an edge portion of the driving flange 61, and the pair of friction pads 141 may be operated by a cylinder 143 which are moved forward and backward by hydraulic pressure, and thus may be pressed onto the both sides of the driven flange 62.

By such an operation, the rotation of the driven flange 62 is restricted by a pressing force of the pair of friction pads 141, and thus the gears of the counter rotation unit 30 are prevented from being additionally damaged by the rotation of the front propeller 10.

Meanwhile, in the embodiment, the disc brake type rotation preventing unit 140 includes the pair of friction pad 141 which presses the both sides of the driven flange 62. Of course, the friction pads may be moved forward and backward by the hydraulic pressure or pneumatic pressure, and thus may be pressed onto the both sides of the driven flange 62.

Hereinafter, a coupling unit and a rotation preventing unit according to another embodiment of the present invention will be described.

Figure 15:
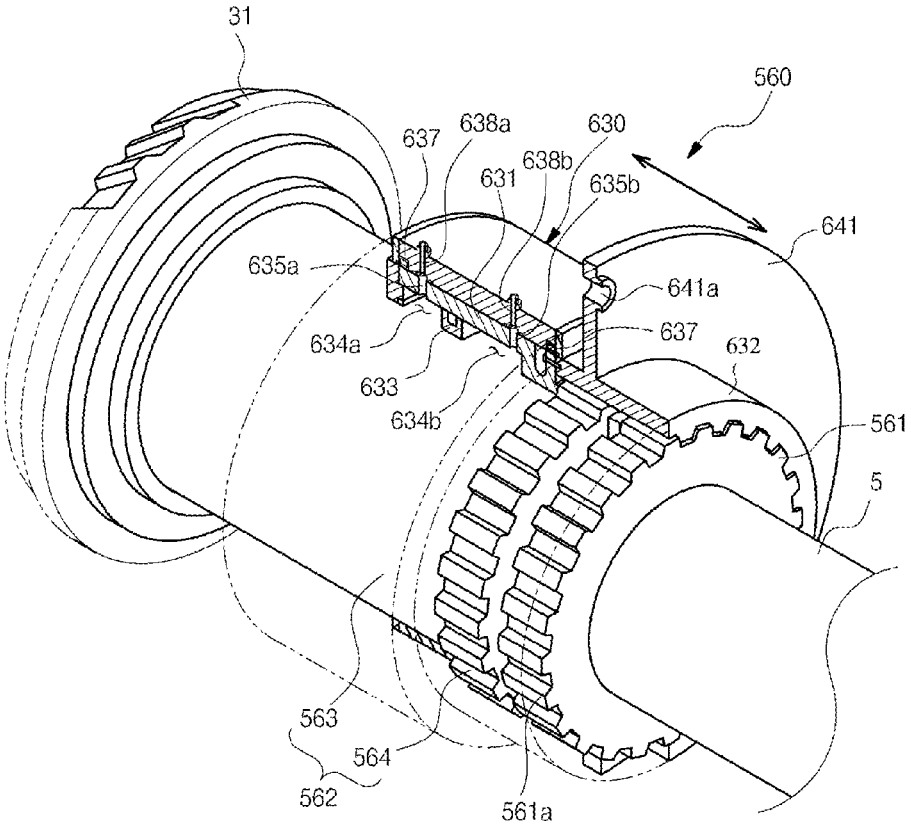
FIG. 15 is a partially cutaway perspective view of a coupling unit of the propulsion device according to another embodiment of the present invention.
Figure 16:
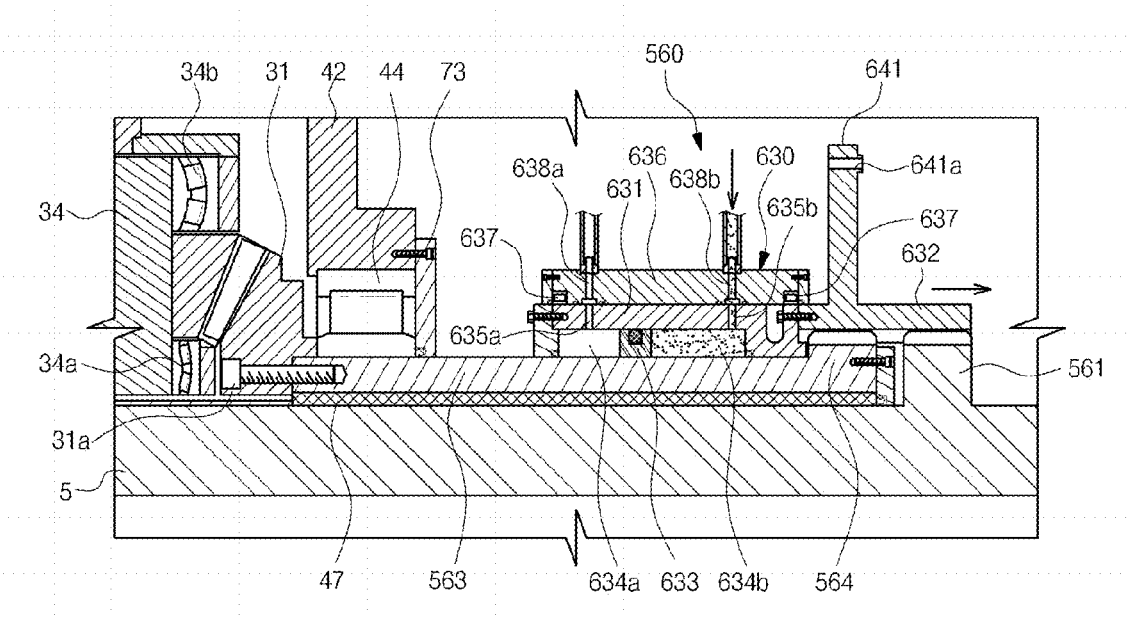
FIG. 16 is a cross-sectional view of a main portion illustrating a state in which the coupling unit is operated in the propulsion device according to another embodiment of the present invention.

FIG. 15 is a partially cutaway perspective view of the coupling unit of the propulsion device according to another embodiment of the present invention, and FIG. 16 is a cross-sectional view of a main portion illustrating a state in which the coupling unit is operated in the propulsion device according to another embodiment of the present invention.

Figure 18:
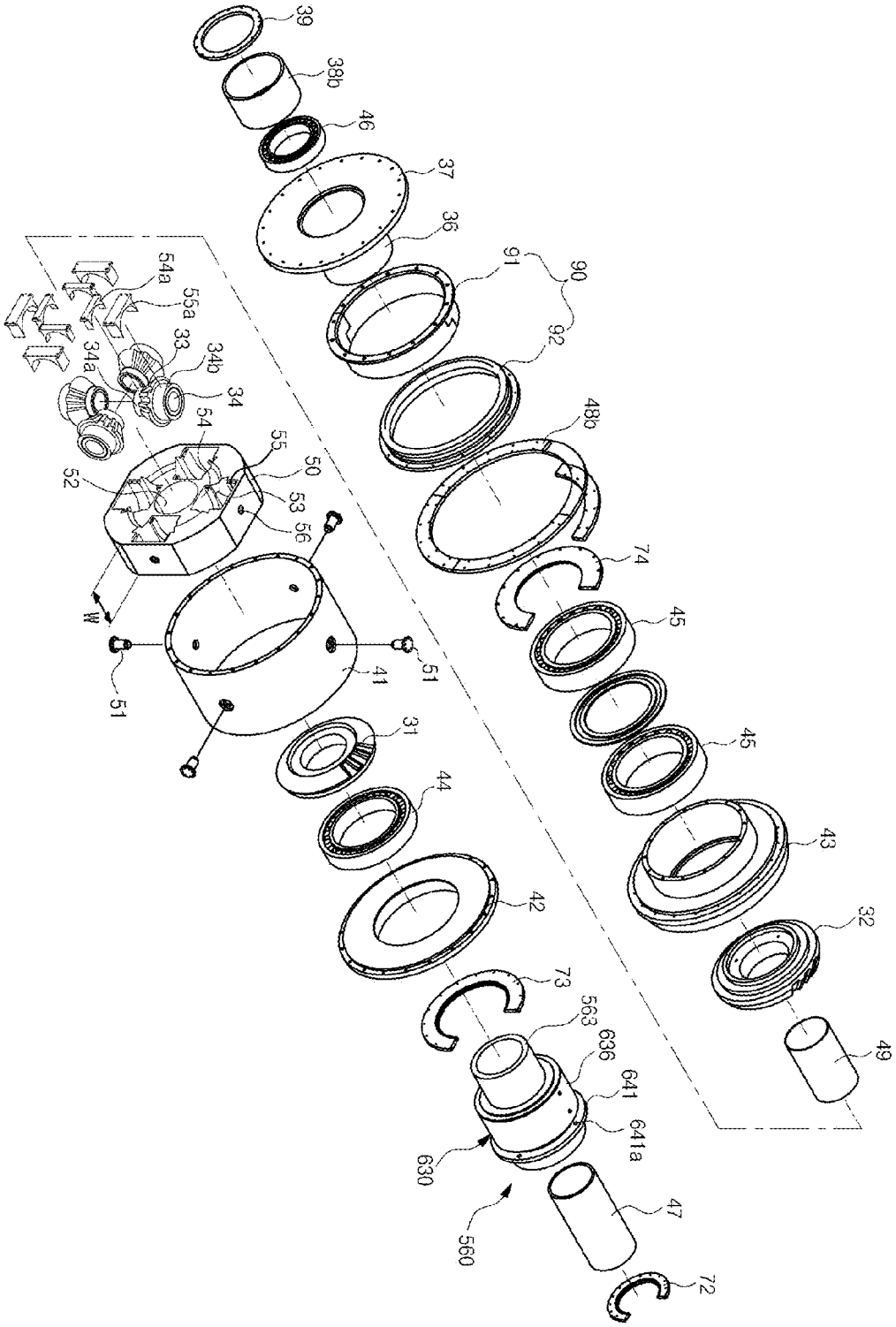
FIG. 18 is an exploded perspective view of a counter rotation unit of a propulsion device according to another embodiment of the present invention.
Figure 19:
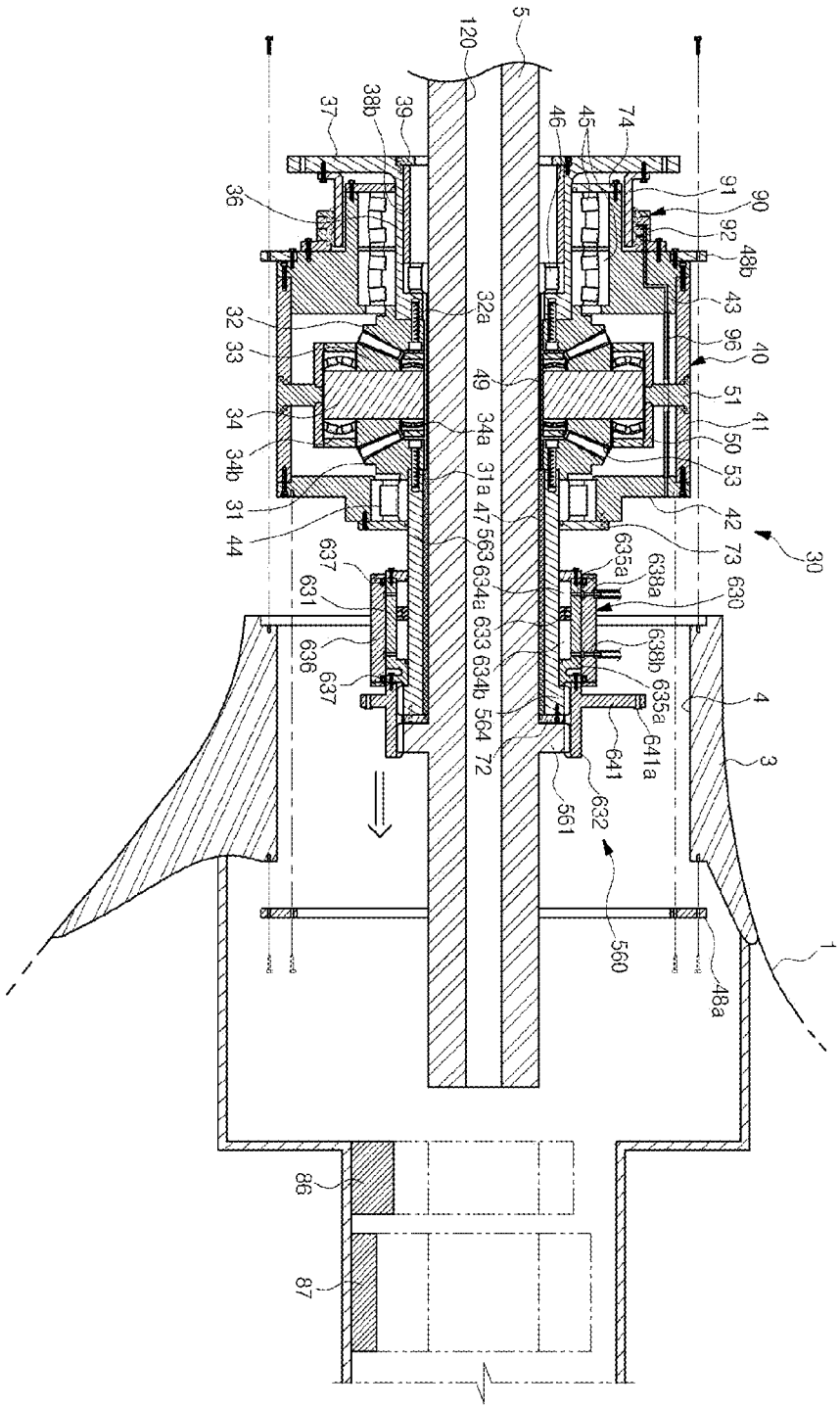
FIG. 19 is a cross-sectional view illustrating an installation example of the counter rotation unit of the propulsion device according to another embodiment of the present invention, wherein the counter rotation unit is separated.

As illustrated in FIGS. 15 and 16, the coupling unit according to another embodiment of the present invention may be configured with a clutch unit 560 which selectively transmits power of the rotational shaft 5 to the counter rotation unit 30. Here, as illustrated in FIGS. 18 and 19, the gear box 40 of the counter rotation unit 30 may include a cylindrical body 41 in which the driving bevel gear 31, the driven bevel gear 32 and the plurality of reverse bevel gear 33 are received and of which both ends are opened, a front cover 42 which is coupled with the body 41 to close a front side opening of the body 41, and a rear cover 43 which is coupled with the body 41 to close a rear side opening of the body 41. The front cover 42 may rotatably support a second gear unit 562, which will be described later, passing through a center portion thereof, and the rear cover 43 may also rotatably support the second connection member 36 passing through a center portion thereof. To this end, a front bearing 44 may be installed between an outer surface of the second gear unit 562 and the front cover 42, and a rear outer bearing 45 may be installed between an outer surface of the second connection member 36 and the rear cover 43.

A plurality of rear outer bearings 45 may be continuously installed in a lengthwise direction of the rotational shaft 5, and thus the second connection member 36 may be stably supported and rotated. A rear inner bearing 46 may be installed between an inner surface of the second connection member 36 and the rotational shaft 5 to rotatably support the second connection member 36, and a cylindrical sleeve bearing 47 may be installed between the second gear unit 562 and the outer surface of the rotational shaft 5. Further, a cylindrical space ring 49 may be installed at the outer surface of the rotational shaft 5 between an inner race of the rear inner bearing 46 and the sleeve bearing 47 to support them.

All of the front bearing 44, the rear outer bearing 45 and the rear inner bearing 46 may be configured with the radial bearings. The bearings 44, 45 and 46 may support the radial load applied to the rotational shaft 5, the second gear unit 562 and the second connection member 36, and may allow stable rotation thereof.

The driving bevel gear 31 is connected with the second gear unit 562 by fastening a plurality of fixing bolts 31*a* so as to be rotated with the second gear unit 562. Also, the driven bevel gear 32 is connected with the second connection member 36 by fastening a plurality of fixing bolts 32*a*. When the driven bevel gear 32 is rotated, an inner diameter portion of the driven bevel gear 32 may be spaced from the rotational shaft 5 to avoid interference with the rotational shaft 5.

The clutch unit 560 may include a first gear unit 561 which is fixed to the rotational shaft 5, the second gear unit 562 which is fixed to the counter rotation unit 30, and a connection unit 630 which selectively connects the first and second gear units 561 and 562. In the embodiment, a driving or operating state of the clutch unit 560 means a state in which the first and second gear units 561 and 562 are connected with each other, and a releasing state of the clutch unit 560 means a state in which the first and second gear units 561 and 562 are disconnected with each other.

The first gear unit 561 may be integrally formed with the rotational shaft 5, or may be separately manufactured and then fixed to the rotational shaft 5 by a welding operation, a press fitting operation, or the like. A first gear portion 561*a* is formed at an outer race thereof.

The second gear unit 562 includes a cylindrical portion 563 which is coupled with the counter rotation unit 30 to extend to a front side thereof, and a second gear portion 564 which is located at an end of the cylindrical portion 563 to be adjacent to the first gear portion 561*a*.

One end of the second gear unit 562 is coupled with the driving bevel gear 31 by the plurality of fixing bolts 31*a*, and the other end is coupled with a sealing cover so as to prevent lubricant filled in the gear box 40 from leaking toward the ship body 1. A cylindrical sleeve bearing 47 may be installed between the second gear unit 562 and the outer surface of the rotational shaft 5.

The connection unit 630 includes a forward and backward movement unit 631 which is provided at an outer diameter of the cylindrical portion 563 to be axially slid, and a connection gear portion 632 which extends from the forward and backward movement unit 631 and has a gear tooth corresponding to the first and second gear portions 561*a* and 564.

The forward and backward movement unit 631 is provided to be selectively axially moved forward and backward, and formed in a cylindrical shape which receives the cylindrical portion 563.

A hydraulic chamber 634*a*, 634*b* in which a fluid is received is formed between the forward and backward movement unit 631 and the cylindrical portion 563. The hydraulic chamber 634*a*, 634*b* is partitioned into first and second hydraulic chambers 634*a* and 634*b* by a fixing portion 633 annularly protruding from the outer diameter of the cylindrical portion 563, and the forward and backward movement unit 631 has a pair of inlet and outlet holes 635*a* and 635*b* which supply or discharge the fluid to/from each of the hydraulic chambers 634*a* and 634*b*.

The connection gear portion 632 is coupled to a front side of the forward and backward movement unit 631 so as to be axially moved forward and backward according to sliding movement of the forward and backward movement unit 631. A gear tooth corresponding to the first and second gear portions 561*a* and 564 is provided at an inner diameter of the connection gear portion 632 to connect the first and second gear portions 561*a* and 564 when the clutch unit 560 is driven and disconnect the first and second gear portions 561*a* and 564 when the driving of the clutch unit 560 is released.

An oil supply member 636 which supplies the fluid to the hydraulic chambers 634*a* and 634*b* is provided at an outer side of the forward and backward movement unit 631.

The oil supply member 636 is formed in a cylindrical shape which surrounds the forward and backward movement unit 631, and oil lines 638*a* and 638*b* in communication with the inlet and outlet holes 635*a* and 635*b* are formed to pass through inner and outer sides of the oil supply member 636.

A bearing 637 is disposed between the forward and backward movement unit 631 and the oil supply member 636 to allow relative rotational movement of the oil supply member 636. Therefore, even when the forward and backward movement unit 631 is rotated, rotation of the oil supply member 636 may be controlled, and thus a position of the oil lines 638*a* and 638*b* may be fixed. The oil supply member 636 is provided to be rotatable with respect to the forward and backward movement unit 631, such that rotation thereof is restricted, and also to be moved forward and backward with the forward and backward movement unit 631 when the forward and backward movement unit 631 is axially moved. At this time, an external hydraulic line (not shown) connected with the oil lines 638*a* and 638*b* may be formed in a flexible tube shape so as to maintain a connection with the oil lines 638*a* and 638*b* even when the oil supply member 636 is moved forward and backward.

The inlet and outlet holes 635*a* and 635*b* of the forward and backward movement unit 631 and the oil lines 638*a* and 638*b* of the oil supply member 636 form a fluid passage, through which the fluid is supplied from an outer side of the clutch unit 560 to the hydraulic chamber 634*a*, 634*b*, so as to supply or discharge oil to/from the first and second hydraulic chambers 634*a* and 634*b* and thus to axially move forward and backward the forward and backward movement unit 631.

That is, when the clutch unit 560 is operated so that the fluid is supplied to the second hydraulic chamber 634*b* through the second oil line 638*b* and the second inlet and outlet hole 635*b* (or the fluid is discharged from the first hydraulic chamber 634*a*), the forward and backward movement unit 631 is moved forward, and the connection gear portion 632 connects the first and second gear portions 561*a* and 564, and thus the power of the rotational shaft 5 is transmitted to the counter rotation unit 30 via the first and second gear units 561 and 562.

Further, when the clutch unit 560 is released so that the fluid is supplied to the first hydraulic chamber 634*a* (or the fluid is discharged from the second hydraulic chamber 634*b*), the forward and backward movement unit 631 is moved backward, and the connection gear portion 632 which connects the first and second gear portions 561*a* and 564 is moved backward according to the forward and backward movement unit 631, such that the connection therebetween is released, and thus the power transmission from the rotational shaft 5 to the counter rotation unit 30 is cut off.

The clutch unit 560 may be operated or released based on an operation of sensing a breakdown in the counter rotation unit 30 or the like, or the operator may apply a signal through an input unit (not shown) to operate or release the clutch unit 560. The clutch unit 560 may be operated through the operation of sensing the breakdown in the counter rotation unit 30 or the like, or the input of the operator, such that the connection gear portion 632 automatically connects or disconnects the first and second gear portions 561*a* and 564, and thus the power of the rotational shaft 5 is selectively transmitted to the counter rotation unit 30.

Outer diameters of the first and second gear portions 561*a* and 564 may be formed to be the same as or different from each other, and thus, if necessary, rotating speeds of the front propeller 10 and the rear propeller 20 may be different from each other. In the embodiment, the forward and backward movement unit 631 is slid using the hydraulic pressure, and thus the clutch unit 560 is operated. However, the clutch unit may be operated using other mechanical structures other than the electronic unit or the hydraulic unit.

For example, when the counter rotation unit 30 breaks down, while the ship runs, the clutch unit 560 may cut off the power transmission from the rotational shaft 5 to the counter rotation unit 30. In this case, the ship may run with only the operation of the rear propeller 20.

At this time, when the ship runs with the operation of the rear propeller 20, the front propeller 10 is rotated by water streams generated according to movement of the ship. When the front propeller 10 is rotated, the plurality of gears 31, 32 and 33 engaged with the front propeller 10 are also rotated. If the plurality of gears 31, 32 and 33 are rotated in the state in which the counter rotation unit 30 breaks down, damage to each component such as the gear may be intensified, and thus it is required to restrict the rotation of the front propeller 10.

To this end, the embodiment has the rotation preventing unit 130 which prevents the rotation of the front propeller 10, when the clutch unit 560 is separated.

Figure 17:
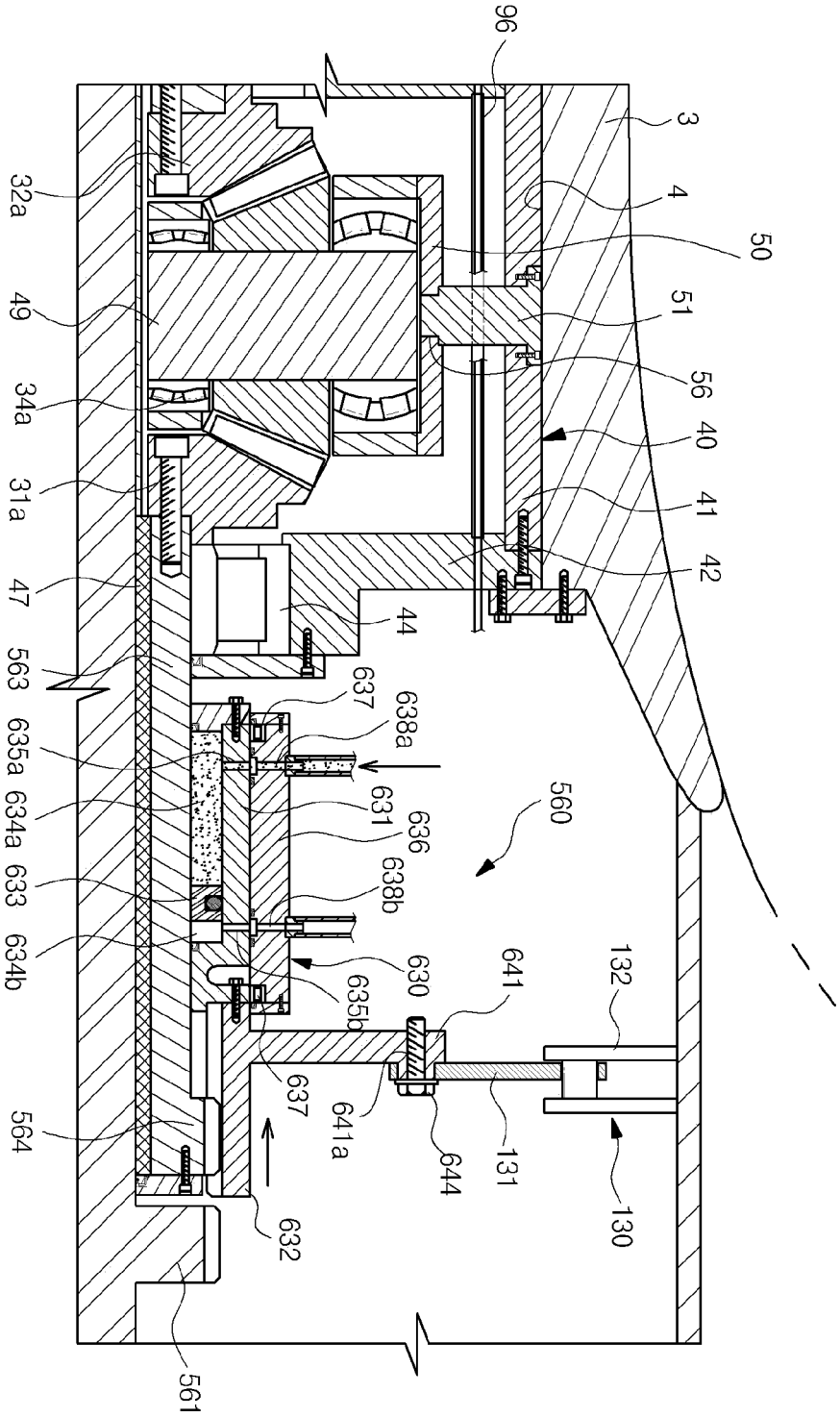
FIG. 17 is a cross-sectional view of a main portion illustrating a state in which a clutch unit is released and the rotational preventing unit is installed in the propulsion device according to the embodiment of the present invention.

FIG. 17 is a cross-sectional view of a main portion illustrating a state in which the clutch unit is released and the rotational preventing unit is installed in the propulsion device according to the embodiment of the present invention.

As illustrated in FIG. 17, the rotation preventing unit 130 may include a flange portion 641 which protrudes axially from an outer circumferential surface of the connection gear portion 632, a shaft frame 132 which is fixed to the ship body 1, and at least one or more shafts 131 of which one end is fixed to the flange portion 641 and the other end is fixed to the shaft frame 132. For example, the flange portion 641 may be formed in a flange shape at the outer circumferential surface of the connection gear portion 632, but is not limited thereto. As long as a position or a shape thereof may restrict the rotation of the counter rotation unit, there is no limitation in the position or the shape.

When the power connection between the first and second gear units 561 and 562 is cut off by the breakdown of the counter rotation unit 30 or the like, the operator couples one end of each shaft 131 provided from an inner side of the ship body 1 toward the front side of the stern 3 of the ship body with the shaft frame 132, and fixes the other end thereof to a fastening hole 641*a* of the flange portion 641 by fastening a bolt 644. Therefore, the gears of the counter rotation unit 30 are prevented from being additionally damaged by the rotation of the front propeller 10.

Referring to FIGS. 2, 4 and 7, a connection flange 37 which is connected with the hub 11 of the front propeller 10 is provided at a rear end of the second connection member 36. The connection flange 37 may be integrally formed with the second connection member 36, or may be fixed to a front surface of the hub 11 of the front propeller 10 by fastening a plurality of fixing bolts 37*a*. Therefore, rotation of the driven bevel gear 32 may be transmitted to the front propeller 10 by the second connection member 36.

Cylindrical third and fourth support rings 38*a* and 38*b* which support the rear inner bearing 46 may be installed between the second connection member 36 and the outer surface of the rotational shaft 5. The third support ring 38*a* is disposed between the inner race of the rear inner bearing 46 and the inner race of the first thrust bearing 13 to maintain a gap therebetween. The fourth support ring 38*b* may be installed at an inner surface side of the second connection member 36 to support an outer race of the rear inner bearing 46. The fixing ring 39 may be installed at the rear end of the second connection member 36 to prevent separation of the fourth support ring 38*b*. As illustrated in FIGS. 2 and 5, the fixing ring 39 may support the outer race of the first thrust bearing 13.

In the counter rotation unit 30, when the rotational shaft 5 is rotated, the first connection member 35 is rotated, and the driving bevel gear 31 connected with the first connection member 35 is rotated. Since the rotation of the driving bevel gear 31 is reversed by the plurality of reverse bevel gears 33, and then transmitted to the driven bevel gear 32, the driven bevel gear 32 is rotated in the opposite direction to the driving bevel gear 31. And the rotation of the driven bevel gear 32 is transmitted to the front propeller 10 by the second connection member. Therefore, counter rotation of the front propeller 10 and the rear propeller 20 may be realized.

As described above, since the counter rotation unit 30 of the embodiment realizes the mutual counter rotation of the two propellers 10 and 20, a volume thereof may be further reduced, compared with a conventional planetary gear type counter rotation unit. Therefore, a volume of the gear box 40 installed at the stern 3 of the ship body may be minimized.

Since the conventional planetary gear type counter rotation unit includes a sun gear installed at a rotational shaft, planet gears installed at an outer side of the sun gear, and a cylindrical internal gear installed at an outer side of the planet gears, a volume thereof is relatively larger. Further, in the planetary gear type counter rotation unit, the internal gear disposed at the outermost side should be rotated, and thus the volume thereof is necessarily increased in consideration of a casing disposed at an outer side thereof. Therefore, like the embodiment, it is practically very difficult to install it at the stern of the ship body. Even though the planetary gear type counter rotation unit may be installed at the stern of the ship body, there is another problem in that a size of the stern of the ship body has to be increased.

As illustrated in FIG. 2, the propulsion device of the embodiment includes a first sealing unit 90 which seals between the stern 3 of the ship body and the hub 11 of the front propeller 10 to prevent introduction of seawater (or freshwater) or foreign substances, and a second sealing unit 110 which seals between the stern 3 of the ship body and the hub 21 of the rear propeller 20 for the same purpose.

Figure 10:
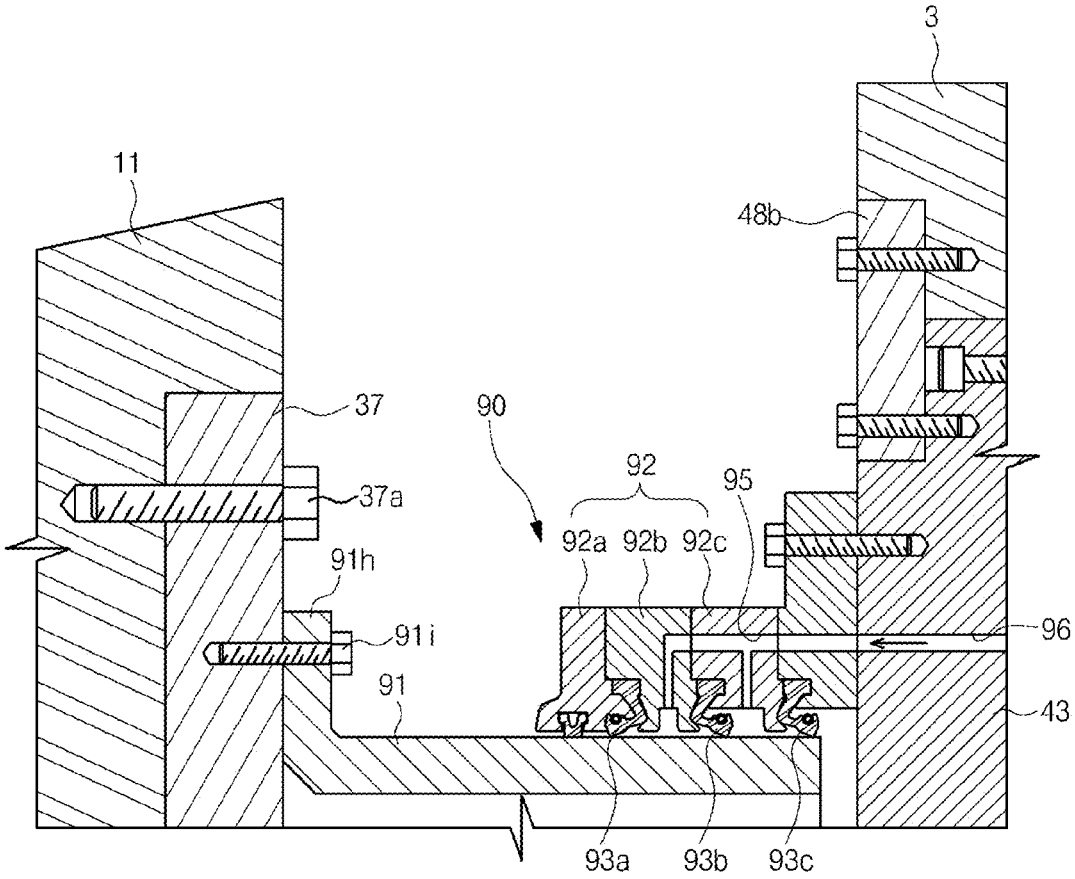
FIG. 10 is a cross-sectional view of a first sealing unit of the propulsion device according to the embodiment of the present invention.

FIG. 10 is a cross-sectional view of the first sealing unit of the propulsion device according to the embodiment of the present invention.

As illustrated in FIG. 10, the first sealing unit 90 may include a first cylindrical lining 91 which is installed at the connection flange 37 of the second connection member 36 fixed to a front surface of the hub 11 of the front propeller, and a first cylindrical seating member 92 which covers an outer surface of the first lining 91 to be in contact with the outer surface of the first lining 91 and of which one end is fixed to the rear cover 43.

The first sealing member 92 includes a plurality of packings 93*a*, 93*b* and 93*c* which are installed at an inner surface thereof facing the first lining 91 to be spaced from each other and to be in contact with the outer surface of the first lining 91, and a fluid passage 95 which supplies a fluid for sealing into grooves among the packings 93*a*, 93*b*, and 93*c*. The fluid passage 95 of the first sealing member 92 may be connected with a lubricant supply passage 96 passing through the front side of the gear box 40 and the rear covers 42 and 43 to supply lubricant having a predetermined pressure (referring to FIG. 2). The lubricant having the predetermined pressure is supplied into the grooves among the packings 93*a*, 93*b*, and 93*c* to press each of the packings 93*a*, 93*b*, and 93*c* onto the first lining 91, and thus may prevent the introduction of the seawater or the foreign substances.

Figure 14:
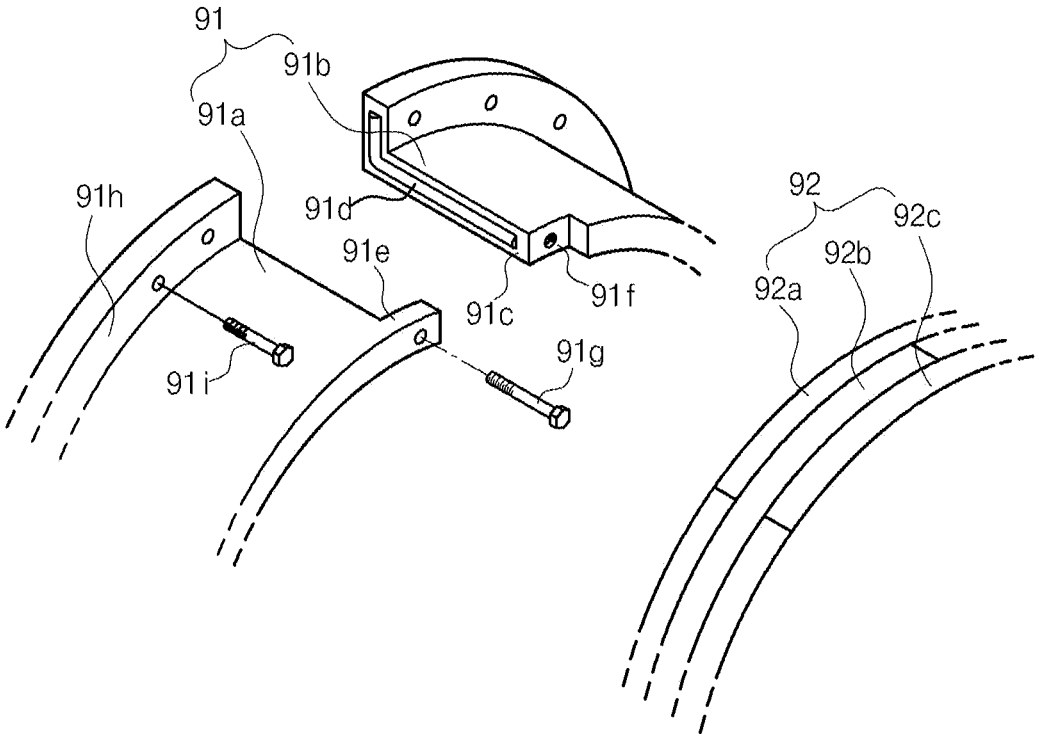
FIG. 14 is an exploded perspective view of the first sealing unit of the propulsion device according to the embodiment of the present invention.

As illustrated in FIG. 14, the first lining 91 may include a first member 91*a* and a second member 91*b* which are divided semicircularly. In addition, a packing 91*d* may be provided at a divided portion 91*c* of the first and second members 91*a* and 91*b* to achieve sealing upon coupling of the first and second members 91*a* and 91*b*. A first coupling portion 91*e* which protrudes from one side toward the other side is provided at a free end of the divided portion 91*c* of the first member 91*a*, and a second coupling portion 91*f* is provided so as to correspond to the first coupling portion at the second member 91*b* which is the other side. As a fixing bolt 91*g* is fastened therethrough, the both sides may be firmly coupled.

A plurality of fixing bolts 91*i* may be fastened to a flange portion 91*h* fixed to the connection flange 37 to firmly fix the flange portion 91*h* to the hub 11. Here, to easily install the first lining 91, the first lining 91 is divided into the both sides. However, the first lining 91 is not limited thereto, and may be formed in a cylindrical shape in which the first member 91*a* and the second member 91*b* are integrally connected.

In the case of the first sealing member 92, the plurality of semicircular rings 92*a*, 92*b*, and 92*c* may be stacked in a lengthwise direction of the rotational shaft 5 at an outer side of the first lining 91 and fixed to one another. The plurality of rings 92*a*, 92*b*, and 92*c* may be coupled to one another via a bolting or welding operation.

Figure 11:
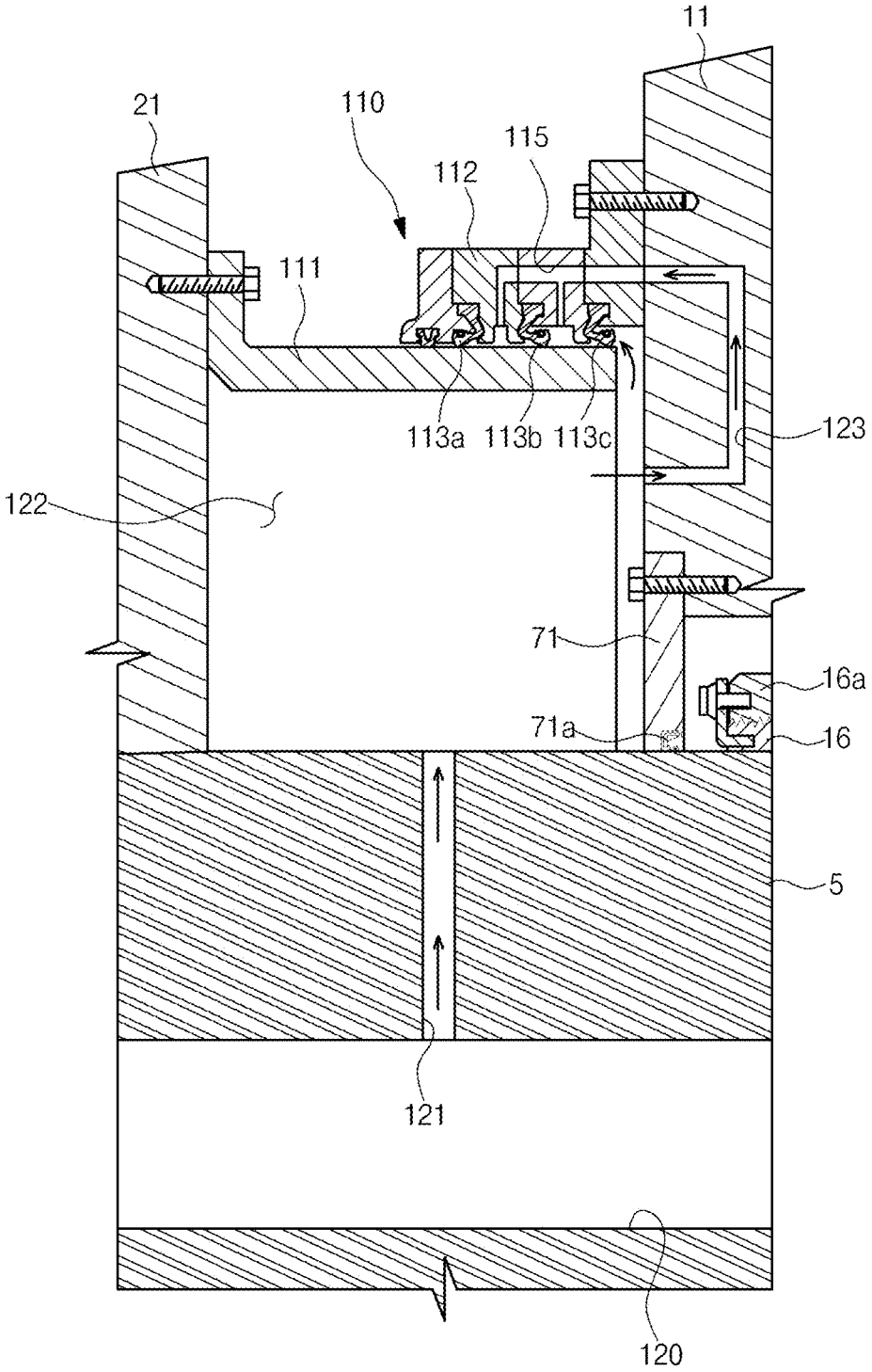
FIG. 11 is a cross-sectional view of a second sealing unit of the propulsion device according to the embodiment of the present invention.

FIG. 11 is a cross-sectional view of the second sealing unit of the propulsion device according to the embodiment of the present invention.

As illustrated in FIG. 11, the second sealing unit 110 may include a second cylindrical lining 111 installed at a front surface of the hub 21 of the rear propeller, and a second cylindrical sealing member 112 which covers an outer surface of the second lining 111 to be in contact with the outer surface of the second lining 111, and of which one end is fixed to a rear surface of the hub 11 of the front propeller. In the same manner as the first sealing member 92, the second sealing member 112 includes a plurality of packings 113*a*, 113*b*, and 113*c* installed at an inner surface thereof, and a fluid passage 115 which supplies a fluid into grooves among the packings.

The fluid passage 115 of the second sealing member 112 may be in communication with a lubricant supply passage 120 formed in a center portion of the rotational shaft 5. To this end, a first radial connection passage 121 which connects the lubricant supply passage 120 with an inner space 122 of the second lining 111 may be formed at the rotational shaft 5, and a second connection passage 123 which connects the inner space 122 of the second lining 111 with the fluid passage 115 of the second sealing member 112 may be formed at the hub 11 of the front propeller. Therefore, the lubricant which is supplied from the center portion of the rotational shaft 5 toward the second sealing member 112 may press the packings 113*a*, 113*b*, and 113*c*, and thus the sealing may be realized.

Similar to the first lining 91 and the first sealing member 92 of the first sealing unit 90, the second lining 111 and the second sealing member 112 may be manufactured to have a semicircular shape and to be coupled after installation of the rear propeller 20.

As illustrated in FIGS. 2 and 5, the front propeller 10 includes a ring-shaped first sealing cover 71 which is installed at a rear surface side of the hub 11 to seal a gap between the outer surface of the rotational shaft 5 and the inner surface of the hub 11. The first sealing cover 71 has a sealing member 71*a* which increases adhesion of an inner circumferential surface thereof in contact with the outer surface of the rotational shaft 5. The first sealing cover 71 may prevent the seawater from being introduced into the gear box 40, even though the seawater is introduced into the inner space 122 of the second lining 111 due to a breakdown of the second sealing unit 110. That is, the first sealing cover 71 may serve as a secondary protective wall, and thus may more completely prevent the introduction of the seawater into the gear box 40.

Referring to FIG. 2, a second sealing cover 72 similar to the first sealing cover 71 may be installed at the driven flange 62 located at the front side of the gear box 40 to seal between the driven flange 62 and the rotational shaft 5. The second sealing cover 72 may prevent the lubricant filled in the gear box 40 from leaking to the ship body 1 side.

The counter rotation unit 30 may include a front surface sealing cover 73 which covers a front surface of the front bearing 44 between the front cover 42 and the first connection member 35, and a rear surface sealing cover 74 which covers a rear surface of the rear outer bearing 45 between the rear cover 43 and the second connection member 36. The front surface sealing cover 73 and the rear surface sealing cover 4 may be provided to be similar to the first sealing cover 71.

The front surface sealing cover 73 and the rear sealing cover 74 may prevent the lubricant in the gear box 40 from leaking to an outer side of the gear box 40. Further, like the first sealing cover 71, the rear surface sealing cover 74 may serve as the secondary protective wall which prevents the introduction of the seawater into the gear box 40.

Further, the propulsion device of the embodiment may include a second radial bearing 81, a third thrust bearing 82 and a fourth thrust bearing 83 which support the rotational shaft 5 at the front side of the gear box 40. The second radial bearing 81 may be fixed to a first bearing support portion 86 in the ship body 1, while being received in a first bearing case 84. The third and fourth thrust bearings 82 and 83 may be fixed to a second bearing support portion 87 in the ship body 1, while being received in a second bearing case 85 so that inner races thereof are mutually supported.

The second radial bearing 81 supports the rotational shaft 5 at the front side of the gear box 40 and prevents radial vibration and shaking of the rotational shaft 5. The third and fourth thrust bearings 82 and 83 serve to transmit an axial force, which is transmitted from the front and rear propellers 10 and 20 to the rotational shaft 5, toward the ship body 1. In particular, the third thrust bearing 82 serves to transmit a force, which is applied from the rotational shaft 5 toward the stern, to the ship body 1, when the ship is moved forward, and the fourth thrust bearing 83 serves to transmit a force, which is applied from the rotational shaft 5 toward the stern, to the ship body 1, when the ship is moved backward.

In FIG. 2, a reference numeral 128 is a first cover ring which covers between the hub 11 of the front propeller 10 and the stern 3 of the ship body located at an outer side of the first sealing unit 90, and a reference numeral 129 is a second cover ring which covers between the hub 21 of the rear propeller and the hub 11 of the front propeller located at an outer side of the second sealing unit 110. The first cover ring 128 may be installed to be fixed to the stern 3 of the ship body and to be slightly spaced from the hub 11 of the front propeller 10, or may be installed to be fixed to the hub 11 of the front propeller 10, while being slightly spaced from the stern 3 of the ship body and to be rotated with the front propeller 10. Also, the second cover 129 may be fixed to one of the hub 11 of the front propeller 10 and the hub 21 of the rear propeller 21 so as to be rotated with the propeller to which the second cover is fixed.

Next, a method of manufacturing the propulsion device according to the embodiment and installing it at the ship body will be described.

As illustrated in FIG. 7, when the propulsion device is installed, the gear box 40 and the related components configuring the counter rotation unit 30, and the rotational shaft 5 are assembled before the propulsion device is installed at the ship body 1. That is, the body 41, the inner frame 50 in which the reverse bevel gear 33 is assembled, the driving bevel gear 31, the driven bevel gear 32, the first connection member 35, the front cover 42, the front bearing 44, the second connection member 36, the rear cover 43, the rear outer bearing 45, or the like are assembled at the outer side of the rotational shaft 5. Also, the first lining 91 and the first sealing member 92 of the first sealing unit 90 are installed between the rear cover 43 and the connection flange 37 of the second connection member 36.

Since each component of the counter rotation unit 30 may be machined at a separate manufacturing plant and then assembled, the counter rotation unit 30 may be precisely manufactured. Further, since the first sealing unit 90 which is generally installed after installation of the front propeller 10 may be previously installed at the counter rotation unit 30, a future operation of installing the propulsion device at the ship body 1 may be simplified.

The rotational shaft 5 and the counter rotation unit 30 assembled in the manufacturing plant may be transported to a dock or the like, at which the ship body 1 is manufactured, using a transportation means, and then installed to the stern 3 of the ship body 1. At this time, a lifting device such as a crane, which may lift an assembly of the counter rotation unit 30, may be used. When the counter rotation unit 30 is installed, first, the gear box 40 of the counter rotation unit 30 is inserted into the installation space 4 formed at the stern 3 of the ship body in a sliding manner. And the counter rotation unit is aligned so that a center of the rotational shaft 5 coincides with a center of the main driving shaft 6.

As illustrated in FIG. 10, after the counter rotation unit 30 is inserted into the installation space 4 formed at the stern 3 of the ship body and then aligned, a front fixing member 48*a* and a rear fixing member are respectively installed at the front and rear sides of the gear box 40 to fix the gear box 40 to the stern 3 of the ship body. The front and rear fixing members 48*a* and 48*b* may be formed to be divided into a plurality of pieces. The front and rear fixing members 48*a* and 48*b* may be fixed to a structure of the stern 3 of the ship body and the gear box 40 by fastening a plurality of fixing bolts.

The rear fixing member 48*b* may be installed by the operator who approaches from the rear side of the ship body 1, and the front fixing member 48*a* may be installed by the operator who approaches from an inner side of the ship body 1. When the breakdown occurs later, the counter rotation unit 30, which is installed to be inserted into the installation space 4 of the stern 3 of the ship body, may be separated from the ship body 1, and then may be repaired in the separated state. Therefore, the repair may be conveniently performed.

In the embodiment, the front fixing member 48*a* and the rear fixing member are installed at the front and rear sides of the gear box 40 to firmly fix the gear box 40. However, if the gear box 40 is inserted into the installation space 4, an outer surface of the gear box 40 is supported by an inner surface of the installation space 4, and thus the gear box 40 may be fixed to the stern 3 of the ship body by only the rear fixing member 48*b*.

After the gear box 40 is fixed to the stern 3 of the ship body, the main driving shaft 6 and the rotational shaft 5 are connected by the coupling unit 7, and the second radial bearing 81 and the third and fourth thrust bearings 82 and 83 are installed in the ship body 1 so that the rotational shaft 5 may be supported by the ship body 1.

After the counter rotation unit 30 is installed at the stern of the ship body, as illustrated in FIGS. 1 and 2, the front propeller 10, the rear propeller 20 and the related components are installed at the rotational shaft 5, and then the second sealing unit 110 is installed, and thus the installation of the propulsion device may be finished.

Next, an operation of the propulsion device according to the embodiment be described.

In the propulsion device, when the rotational shaft 5 is rotated by an operation of the driving source 8 located in the ship body 1, the rear propeller 20 directly connected with the rear end of the rotational shaft 5 is rotated together in the same direction as a rotating direction of the rotational shaft 5. At the same time, since the driving bevel gear 31 of the counter rotation unit 30 is fixed to the rotational shaft 5, the driving bevel gear 31 is also rotated with the rotational shaft 5. Since rotation of the driving bevel gear 31 is reversed by the plurality of reverse bevel gears 33, and then transmitted to the driven bevel gear 32, the driven bevel gear 32 is rotated in the opposite direction to the rotating direction of the rotational shaft 5. Therefore, the front propeller 10 which is connected with the driven bevel gear 32 via the second connection member 36 is rotated in the opposite direction to the rotating direction of the rear propeller 20.

Since the front and rear propellers 10 and 20 which are rotated in the opposite directions with respect to each other have blade angles opposite to each other, and thus generate propulsive water streams in the same direction. That is, the front and rear propellers generate rearward propulsive water streams during forward movement of the ship, and generate forward propulsive water streams via the counter rotation thereof during rearward movement of the ship. In addition, with regard to the propulsive water streams generated during the forward movement of the ship, the rear propeller 20 acquires propulsive force from rotational energy of fluid passed through the front propeller 10 via reverse rotation thereof, which results in enhanced propulsion performance. This is equally applied during the rearward movement of the ship.

Meanwhile, the front propeller 10 generates the rearward propulsive water streams during the forward movement, and thus is affected by corresponding repulsive force. This force is transmitted to the rotational shaft 5 via the second thrust bearing 14, thereby serving as the propulsive force. Similarly, the rear propeller 20 generates the rearward propulsive water streams during the forward movement, and thus is affected by the repulsive force. This force is similarly transmitted to the rotational shaft 5 directly connected to the rear propeller, thereby serving as the propulsive force.

During the rearward movement of the ship, the propulsive force of the front propeller 10 is transmitted to the rotational shaft 5 via the first thrust bearing 13, and the propulsive force of the rear propeller 20 is also transmitted to the rotational shaft 5 directly connected to the rear propeller.

In conclusion, the propulsive force generated through the operation of the front propeller 10 and the rear propeller 20 during the forward and rearward movement of the ship is transmitted to the rotational shaft 5. And the propulsive force transmitted to the rotational shaft 5 is transmitted to the ship body 1 via the third and fourth thrust bearings 82 and 83, and thus propulsion of the ship is achieved.

When an emergency state such as the breakdown of the counter rotation unit 30 occurs during the movement of the ship, first, the engine is stopped, and the coupling unit 60 is separated so as to cut off the power transmission from the rotational shaft 5 to the counter rotation unit 30. To this end, the connection bolts 64 which couple the driving flange 61 with the driven flange 62 are separated, and then the friction member 63 disposed between the driving flange 61 with the driven flange 62 is separated.

Then, the rotation of the front propeller 10 is restricted using the rotation preventing unit 130. As illustrated in FIG. 9, the both ends of the shaft 131 are fixed to the fastening hole 62*a* of the driven flange 62 and the shaft frame 132 within the stern of the ship body, respectively.

While the power transmission from the rotational shaft 5 to the counter rotation unit 30 is cut off, and the rotation of the front propeller 10 is restricted, the engine is operated. Therefore, damage to the components such as the plurality of gear parts 31, 32 and 33 within the counter rotation unit 30 may be prevented, and the ship may be run with only the propulsive force of the rear propeller 20.

Meanwhile, in the case of the embodiment of FIGS. 16 and 17, the clutch unit 560 is released by a signal transmitted through a sensor or the like, or an input device (not shown) operated by the operator. When the clutch unit 560 is released, the forward and backward movement unit 631 is moved backward, and the connection between the first gear unit 561 and the second gear unit 562 is released, and thus the power transmission from the rotational shaft 5 to the counter rotation unit 30 is cut off.

Then, the rotation of the front propeller 10 is restricted using the rotation preventing unit 130. The both ends of the shaft 131 are fixed to the fastening hole 641*a* of the flange portion 641 and the shaft frame 132 of the stern 3 of the ship body, respectively.

Since the engine is operated, while the power transmission from the rotational shaft 5 to the counter rotation unit 30 is cut off, and the rotation of the front propeller 10 is restricted, the damage to the components such as the plurality of gear parts 31, 32 and 33 within the counter rotation unit 30 may be prevented, and the ship may be run with only the propulsive force of the rear propeller 20.

Although a few embodiments of the present invention have been shown and described, it would be appreciated by those skilled in the art that changes may be made in these embodiments without departing from the principles and spirit of the invention, the scope of which is defined in the claims and their equivalents.

[Industrial Applicability]

The invention claimed is:

1. A ship propulsion device comprising:

a rotational shaft;

a rear propeller fixed to the rotational shaft;

a front propeller rotatably supported by the rotational shaft in front of the rear propeller;

a counter rotation unit disposed in an installation space of a stern of a ship body and including a plurality of gears configured to reverse rotation of the rotational shaft and transmit the reversed rotation to the front propeller and a gear box configured to receive the plurality of gears;

a coupling unit configured to separably connect the rotational shaft with the counter rotation unit and cut off power transmission from the rotational shaft to the counter rotation unit upon disconnection therebetween; and a rotation preventing unit configured to prevent rotation of the front propeller when the coupling unit is separated, wherein the coupling unit comprises a driving flange formed in a radial direction of the rotational shaft, and a plurality of connection bolts configured to pass through the driving flange and couple the rotational shaft with the counter rotation unit, wherein the plurality of gears comprises a driving bevel gear, a driven bevel gear configured to transmit power to the front propeller, one or more reverse bevel gears configured to reverse rotation of the driving bevel gear and transmit the reversed rotation to the driven bevel gear, and a first connection member connected with the driving bevel gear to extend toward the driving flange, wherein the coupling unit further comprises a driven flange configured to extend from the counter rotation unit and receive a driving force of the rotational shaft, and the rotation preventing unit comprises a shaft configured to fix the driven flange to the ship body, and wherein the coupling unit comprises a clutch unit including a first gear unit fixed to the rotational shaft, a second gear unit fixed to the counter rotation unit, and a connection unit configured to selectively connect the first gear unit with the second gear unit.

2. The device of claim 1, wherein the coupling unit comprises a friction member disposed between the rotational shaft and the counter rotation unit to prevent slippage.

3. The device of claim 2, wherein the friction member is formed into a plurality of pieces which are allowed to be separated between the rotational shaft and the counter rotation unit, when the connection bolts are separated.

4. The device of claim 1, wherein the driven flange comprises a fastening hole to which one end of the shaft is fixed, and the ship body comprises a shaft frame to which the other end of the shaft is fixed.

5. The device of claim 1, wherein the rotation preventing unit restricts rotation of the first connection member, when a connection between the first connection member and the driving flange is released.

6. The device of claim 1, wherein the coupling unit further comprises a driven flange configured to extend from the counter rotation unit and receive a driving force of the rotational shaft, and the rotation preventing unit further comprises a disc brake having a pair of friction pads disposed at both sides of an edge portion of the driven flange to face each other.

7. The device of claim 1, wherein the second gear unit comprises a cylindrical portion coupled to the counter rotation unit, and a second gear portion disposed at an end of the cylindrical portion to be adjacent to a first gear portion of the first gear unit.

8. The device of claim 7, wherein the connection unit comprises a forward and backward movement unit provided at an outer diameter of the cylindrical portion to be axially slid along the cylindrical portion, and a connection gear part configured to extend from the forward and backward movement unit and correspond to the first and second gear portions.

9. The device of claim 8, wherein the clutch unit comprises a hydraulic chamber partitioned between the forward and backward movement unit and the second gear unit and configured to receive a fluid to allow the forward and backward movement unit to be slid.

10. The device of claim 9, wherein the clutch unit comprises a fluid passage configured to supply a fluid to the hydraulic chamber.

11. The device of claim 1, wherein the plurality of gears comprises a driving bevel gear, a driven bevel gear configured to transmit power to the front propeller, and one or more reverse bevel gears configured to reverse rotation of the driving bevel gear and transmit the reversed rotation to the driven bevel gear, and the second gear unit is connected with the driving bevel gear to extend toward the first gear unit.

* * * * *